US010314754B2

(12) United States Patent
Karwal et al.

(10) Patent No.: US 10,314,754 B2
(45) Date of Patent: Jun. 11, 2019

(54) PATIENT CARE AND TRANSPORT ASSEMBLY

(71) Applicant: B & R Holdings Company, LLC

(72) Inventors: Deepak Raj Karwal, Berkley, MI (US); Ricky C. Simmonds, Brampton (CA); Tomas Bubilek, Pasadena, CA (US)

(73) Assignee: B & R HOLDINGS COMPANY, LLC, Berkley, MI (US)

( * ) Notice: Subject to any disclaimer, the term of this patent is extended or adjusted under 35 U.S.C. 154(b) by 1186 days.

(21) Appl. No.: 14/011,321

(22) Filed: Aug. 27, 2013

(65) Prior Publication Data

US 2013/0340167 A1 Dec. 26, 2013

Related U.S. Application Data

(63) Continuation-in-part of application No. 12/849,197, filed on Aug. 3, 2010, now Pat. No. 8,516,637.
(Continued)

(51) Int. Cl.
*A61G 7/08* (2006.01)
*A61G 7/012* (2006.01)
(Continued)

(52) U.S. Cl.
CPC ..... *A61G 7/08* (2013.01); *A61G 7/005* (2013.01); *A61G 7/008* (2013.01); *A61G 7/012* (2013.01);
(Continued)

(58) Field of Classification Search
CPC ..... A61G 13/0009; A61G 2007/0509; A61G 2007/0514; A61G 2203/20;
(Continued)

(56) References Cited

U.S. PATENT DOCUMENTS 1,984,311 A 12/1934 Lamar et al.
2,322,683 A 6/1943 Costa et al.
(Continued)

FOREIGN PATENT DOCUMENTS

JP 2001293041 10/2001
JP 2004089666 A 3/2004
(Continued)

OTHER PUBLICATIONS

Savion Industries Ltd, Hospital Equipment, Medical Supply, Hospital . . . http://www.savion.co.il/savMotorized.htm Savion Advanced Patient Care,website page 1 of 2 Aug. 26, 2013.
(Continued)

*Primary Examiner* — Eric J Kurilla
*Assistant Examiner* — Amanda L Bailey
(74) *Attorney, Agent, or Firm* — Dinsmore & Shohl, LLP

(57) ABSTRACT

A versatile patient care and transport assembly having a patient support frame constructed of multiple sections, each including pluralities of individual patient sensors, and which can be cooperatively tilted or otherwise inter-articulated to a variety of support positions. Pull-out/expandable side and end railings are provided for patient safety. Power and drive components are incorporated into a base module upon which the patient support module is mounted in multiple elevatable and/or articulating fashion. Also provided is paired side-by-side docking of two identical assemblies such as for facilitate patient transfer and in order to drastically reduce the risks associated with handling of patients by caregivers.

14 Claims, 36 Drawing Sheets

Related U.S. Application Data

(60) Provisional application No. 61/231,450, filed on Aug. 5, 2009.

(51) Int. Cl.

| | |
|---|---|
| ***A61G 7/10*** | (2006.01) |
| ***A61G 7/005*** | (2006.01) |
| ***A61G 7/008*** | (2006.01) |
| ***A61G 7/015*** | (2006.01) |
| ***A61G 7/05*** | (2006.01) |
| ***A61G 7/16*** | (2006.01) |
| ***A61G 13/00*** | (2006.01) |
| *A61G 7/057* | (2006.01) |

(52) U.S. Cl.
CPC ..... *A61G 7/015* (2013.01); *A61G 7/0507* (2013.01); *A61G 7/0509* (2016.11); *A61G 7/0514* (2016.11); *A61G 7/1025* (2013.01); *A61G 7/1026* (2013.01); *A61G 7/16* (2013.01); *A61G 13/0009* (2013.01); *A61G 7/05738* (2013.01); *A61G 2203/20* (2013.01); *A61G 2203/44* (2013.01); *A61G 2203/46* (2013.01); *A61G 2203/80* (2013.01)

(58) Field of Classification Search
CPC .... A61G 2203/80; A61G 7/005; A61G 7/008; A61G 7/012; A61G 7/015; A61G 7/0507; A61G 7/05738; A61G 7/08; A61G 7/1025; A61G 7/1026; A61G 7/16; A61G 2007/0519; A61G 2005/1045; A61G 2005/1048; A61G 5/1043; A61G 2203/30–2203/46
See application file for complete search history.

(56) References Cited

U.S. PATENT DOCUMENTS 3,138,805 A 6/1964 Piazza
3,729,751 A 5/1973 Kirkman
3,900,906 A 8/1975 Berthelsen
4,717,169 A 1/1988 Shaffer
4,862,529 A 9/1989 Peck
4,949,408 A 8/1990 Trkla
4,974,905 A 12/1990 Davis
4,982,466 A 1/1991 Higgins et al.
4,987,620 A 1/1991 Sharon
5,003,654 A 4/1991 Vrzalik
5,083,625 A * 1/1992 Bleicher ..... B62D 61/10 180/202
5,179,745 A 1/1993 Hebert et al.
5,333,887 A 8/1994 Luther
5,337,845 A * 8/1994 Foster ..... A61G 12/008 180/11
5,370,111 A 12/1994 Reeder et al.
5,377,371 A 1/1995 Foster
5,402,544 A 4/1995 Crawford et al.
5,410,768 A 5/1995 Manson et al.
5,513,406 A 5/1996 Foster et al.
5,555,582 A 9/1996 Jerideau
5,640,728 A * 6/1997 Graebe ..... A47C 7/744 5/423
5,659,910 A 8/1997 Weiss
5,680,661 A 10/1997 Foster et al.
5,715,548 A 2/1998 Weismiller et al.
5,790,997 A 8/1998 Ruehl
5,802,640 A 9/1998 Ferrand et al.
5,860,664 A 1/1999 Smith
5,996,150 A 12/1999 Blevins et al.
6,163,903 A 12/2000 Weismiller et al.
6,272,702 B1 8/2001 Uchida et al.
6,282,736 B1 9/2001 Hand et al.
6,336,235 B1 1/2002 Ruehl
6,353,949 B1 3/2002 Falbo
6,360,389 B1 3/2002 Gallant et al.
6,367,106 B1 * 4/2002 Gronsman ..... A47C 4/54 5/655.3
6,367,873 B1 4/2002 Dorner et al.
6,374,436 B1 4/2002 Foster et al.
6,381,781 B1 5/2002 Bourgraf et al.
6,385,801 B1 5/2002 Watanabe et al.
6,386,614 B1 5/2002 Logan
6,393,641 B1 5/2002 Hensley
6,427,270 B1 8/2002 Blevins et al.
6,499,163 B1 12/2002 Stensby
6,536,056 B1 3/2003 Vrzalik et al.
6,564,409 B2 5/2003 Metz et al.
6,584,629 B2 7/2003 Tsuji et al.
6,651,279 B1 11/2003 Muthuvelan
6,691,346 B2 2/2004 Osborne et al.
6,694,548 B2 2/2004 Foster et al.
6,725,474 B2 4/2004 Foster et al.
6,725,956 B1 4/2004 Lemire
6,742,202 B2 * 6/2004 Jones ..... A47C 23/002 5/263
6,772,456 B2 8/2004 Votel
6,772,850 B1 8/2004 Waters et al.
6,834,402 B2 12/2004 Hanson et al.
6,857,147 B2 2/2005 Somasundaram
6,862,761 B2 3/2005 Hand et al.
6,877,572 B2 4/2005 Vogel et al.
6,892,405 B1 5/2005 Dimitriu et al.
6,895,715 B2 5/2005 Gallant et al.
6,904,631 B2 6/2005 Vrzalik et al.
6,951,036 B2 10/2005 Lemire
6,957,457 B2 10/2005 Stryker et al.
6,957,461 B2 10/2005 Osborne et al.
6,978,499 B2 12/2005 Gallant et al.
6,978,500 B2 12/2005 Osborne et al.
6,978,501 B2 12/2005 Vrzalik
6,993,799 B2 2/2006 Foster et al.
7,000,272 B2 2/2006 Allen et al.
7,003,830 B2 2/2006 Ito
7,007,765 B2 3/2006 Waters et al.
7,017,208 B2 3/2006 Weismiller et al.
7,018,157 B2 3/2006 Gallant et al.
7,028,352 B2 4/2006 Kramer et al.
7,040,693 B1 5/2006 Dorner et al.
D527,459 S 8/2006 Gireesh
7,082,630 B2 8/2006 Castonguay et al.
7,083,012 B2 8/2006 Vogel et al.
7,089,612 B2 8/2006 Rocher et al.
7,090,041 B2 8/2006 Vogel et al.
7,107,637 B2 9/2006 Kuek et al.
7,125,167 B2 10/2006 Alakkat
7,131,154 B2 11/2006 Davis et al.
7,195,253 B2 3/2007 Vogel et al.
7,219,754 B2 5/2007 Johnson
7,234,179 B2 6/2007 Shaw
7,237,287 B2 7/2007 Weismiller et al.
7,243,386 B2 7/2007 Gallant et al.
7,254,850 B2 8/2007 Newkirk et al.
7,296,312 B2 11/2007 Menkedick et al.
7,305,727 B2 12/2007 Horlin
7,340,784 B2 3/2008 Stryker et al.
7,346,945 B2 3/2008 Phillips et al.
7,363,663 B2 4/2008 Chambers et al.
7,392,621 B2 7/2008 Gallant et al.
7,419,019 B1 9/2008 White et al.
7,426,759 B2 9/2008 Donaldson
7,451,505 B2 11/2008 Johannsen
7,454,805 B2 11/2008 Osborne et al.
7,458,119 B2 12/2008 Hornbach et al.
7,472,439 B2 1/2009 Lemire et al.
7,472,440 B2 1/2009 Bartlett et al.
7,478,446 B2 1/2009 Sims, Jr.
7,480,951 B2 1/2009 Weismiller et al.
7,481,286 B2 1/2009 Ruschke et al.
7,533,742 B2 5/2009 Johnson et al.
7,552,733 B1 6/2009 Schubert, III
7,559,102 B1 7/2009 Benzo et al.
7,631,749 B2 12/2009 Somasundaram et al.

(56) References Cited

U.S. PATENT DOCUMENTS

| | | | | |
|---|---|---|---|---|
| 7,676,872 | B2 * | 3/2010 | Block | A47C 23/002 5/690 |
| 7,757,318 | B2 | 7/2010 | Poulos et al. | |
| 8,165,718 | B2 | 4/2012 | Ota et al. | |
| 2002/0059679 | A1 | 5/2002 | Weismiller et al. | |
| 2003/0000015 | A1 | 1/2003 | Horlin | |
| 2003/0093862 | A1 | 5/2003 | Hanson et al. | |
| 2004/0034936 | A1 | 2/2004 | Welling et al. | |
| 2004/0090333 | A1 | 5/2004 | Wildman et al. | |
| 2004/0128765 | A1 | 7/2004 | Osborne et al. | |
| 2004/0163175 | A1 | 8/2004 | Vogel et al. | |
| 2006/0065060 | A1 * | 3/2006 | Ito | A61B 5/103 73/862.046 |
| 2006/0090261 | A1 | 5/2006 | Vrzalik | |
| 2006/0096029 | A1 | 5/2006 | Osborne et al. | |
| 2006/0112489 | A1 | 6/2006 | Bobey et al. | |
| 2006/0191073 | A1 | 8/2006 | Honda | |
| 2006/0279427 | A1 | 12/2006 | Becker et al. | |
| 2007/0089238 | A1 * | 4/2007 | Kramer | A61G 7/015 5/618 |
| 2007/0113342 | A1 | 5/2007 | Foster et al. | |
| 2007/0157385 | A1 | 7/2007 | Lemire et al. | |
| 2007/0163043 | A1 | 7/2007 | Lemire et al. | |
| 2007/0163045 | A1 | 7/2007 | Becker et al. | |
| 2007/0164871 | A1 | 7/2007 | Dionne et al. | |
| 2007/0169268 | A1 | 7/2007 | Lemire et al. | |
| 2007/0174964 | A1 | 8/2007 | Lemire et al. | |
| 2007/0174965 | A1 | 8/2007 | Lemire et al. | |
| 2007/0266499 | A1 * | 11/2007 | O'Keefe | A61G 7/015 5/713 |
| 2008/0005838 | A1 | 1/2008 | Wan Fong et al. | |
| 2008/0035396 | A1 | 2/2008 | Heimbrock et al. | |
| 2008/0141459 | A1 * | 6/2008 | Hamberg | A61G 7/05 5/600 |
| 2008/0276372 | A1 * | 11/2008 | Lambarth | A61G 1/04 5/611 |
| 2009/0031498 | A1 | 2/2009 | Girard et al. | |
| 2009/0211026 | A1 | 8/2009 | Schoff | |
| 2010/0005592 | A1 | 1/2010 | Poulos et al. | |
| 2010/0256512 | A1 * | 10/2010 | Sullivan | A61B 5/113 600/529 |
| 2010/0268121 | A1 * | 10/2010 | Kilborn | A61B 5/412 600/587 |
| 2011/0245732 | A1 * | 10/2011 | Mravyan | A61B 5/1116 600/587 |

FOREIGN PATENT DOCUMENTS

| | | |
|---|---|---|
| KR | 20010050998 | 6/2001 |
| KR | 100743969 | 7/2007 |
| TW | 262789 B | 10/2006 |

OTHER PUBLICATIONS

510(k) Summary for the Savion Industries "Medi-Cruiser" Model MS777 2 pages, Summary dated May 22, 2005.

Department of Health & Human Services, Letter to Mr. Steli Loznen, M.Sc. Head of Medical Devices Safety Branch, Savion Industries, LTD. dated Sep. 28, 2005 , three pages re: K051861, The Savion Industries "Medi-Cruiser" Model MS777.

* cited by examiner

PATIENT CARE AND TRANSPORT ASSEMBLY

CROSS-REFERENCE TO RELATED APPLICATIONS

This Application is a Continuation-in-part of application Ser. No. 12/849,197 filed on Aug. 3, 2010. Application Ser. No. 12/849,197 claims the benefit of U.S. Provisional Application 61/231,450 filed on Aug. 5, 2009, the contents of which are incorporated herein in their entirety.

FIELD OF THE INVENTION

The present invention discloses a versatile patient care and transport assembly, particularly suited for general transport use within a hospital or like setting. More specifically, the assembly is multi-functional and includes a patient support frame constructed of multiple sections, each including pluralities of individual patient sensors, and which can be cooperatively tilted or otherwise inter-articulated to a variety of support positions. Other features include the provision of pull-out/expandable side and end railings for patient safety. Power (i.e. quick rechargeable battery system) and drive components are incorporated into a base module upon which the patient support module is mounted in multiple elevatable and/or deflectable fashion. Also provided is paired side-by-side docking of two identical assemblies such as for facilitate patient transfer and in order to drastically reduce the risks associated with handling of patients by caregivers.

BACKGROUND OF THE INVENTION

The prior art is well documented with examples of mobile bed and chair transports, such as for use in hospitals or other medical care giving facilities for efficiently moving patients. A shortcoming of the existing art has been the ability to integrate into a single and multi-functional assembly the features of powered transport, bed/chair convert-ability and adjustability for moving patients.

SUMMARY OF THE INVENTION

The present invention discloses a versatile patient care and transport assembly, particularly suited for general transport use within a hospital or like setting. More specifically, the assembly is multi-functional and includes a patient support frame constructed of multiple sections, each including pluralities of individual patient sensors, and which can be cooperatively tilted or otherwise inter-articulated to a variety of support positions. Other features include the provision of pull-out/expandable side and end railings for patient safety. Power and drive components are incorporated into a base module upon which the patient support module is mounted in multiple elevatable and/or deflectable fashion. Also provided is paired side-by-side docking of two identical assemblies such as to facilitate patient transfer and in order to drastically reduce the risks associated with handling of patients by caregivers.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

As will be described in furthering detail with reference to each of the illustrations, the present invention discloses a versatile patient support system, such as for use with hospitals, nursing/patient care facilities and other applications. A patient support sub-assembly is supported atop a transport base and incorporates a variety of motion and articulation features that provide ease of use and drastically reduce the risks associated with handling of patients by caregivers.

More specifically, the assembly is multi-functional, modularized (i.e. plug-play) able to custom configure and includes a patient support frame constructed of multiple sections, each including pluralities of individual patient sensors, and which can be cooperatively tilted or otherwise inter-articulated to a variety of support positions. Other features include the provision of pull-out/expandable side and end railings for patient safety.

Power and drive components are incorporated into a base module upon which the patient support module is mounted in multiple elevatable and/or deflectable fashion. Also provided is paired side-by-side docking of two identical assemblies such as for facilitate patient transfer and in order to drastically reduce the risks associated with handling of patients by caregivers.

Figure 1:
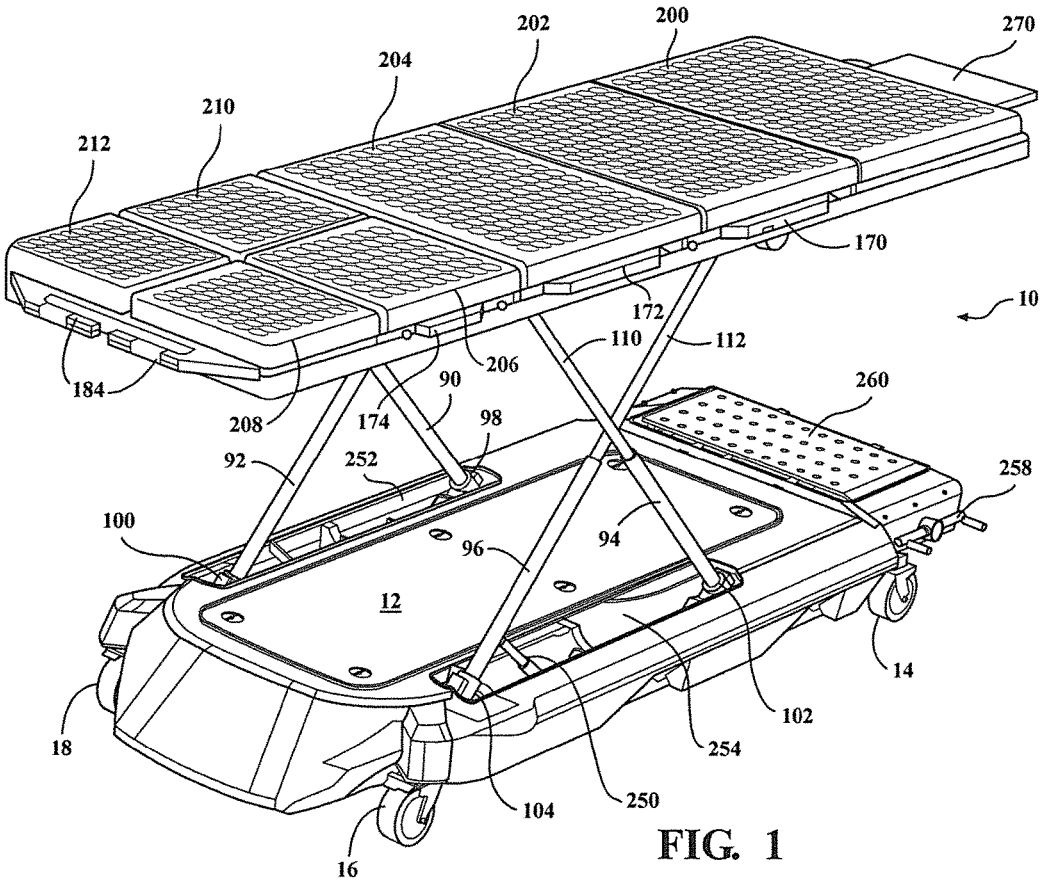
FIG. 1 is a perspective view of the patient support and transport assembly in an extended and horizontal support position.

The patient transport assembly is generally shown in a fully assembled and maximum vertically extended patient support surface position, at 10 in FIG. 1. A component containing and powered base 12 is provided and includes a three dimensional body exhibiting a flattened rectangular configuration with a specified thickness. The body is supported upon a plurality of outer (typically four and may in non-limiting fashion be individually motor driven) castors or rollers 14, 16, 18 and 20 (see also FIG. 31), each of these being pivotally supported at a generally outer corner location of a structural frame, and as best depicted by sides 22 and 24 and interconnected ends 26 and 28 in FIG. 26. As further shown, any suitable supporting bracketry can be employed for traversably supporting the base, and such as depicted by horizontal extending and spacing brackets as at 30 in FIG. 26 for selected roller 14 as well as underside attaching bracket 32 for further selected roller 16. In this fashion, the outer rollers provide passive and multi-directional traverse-ability of the assembly.

Figure 26:
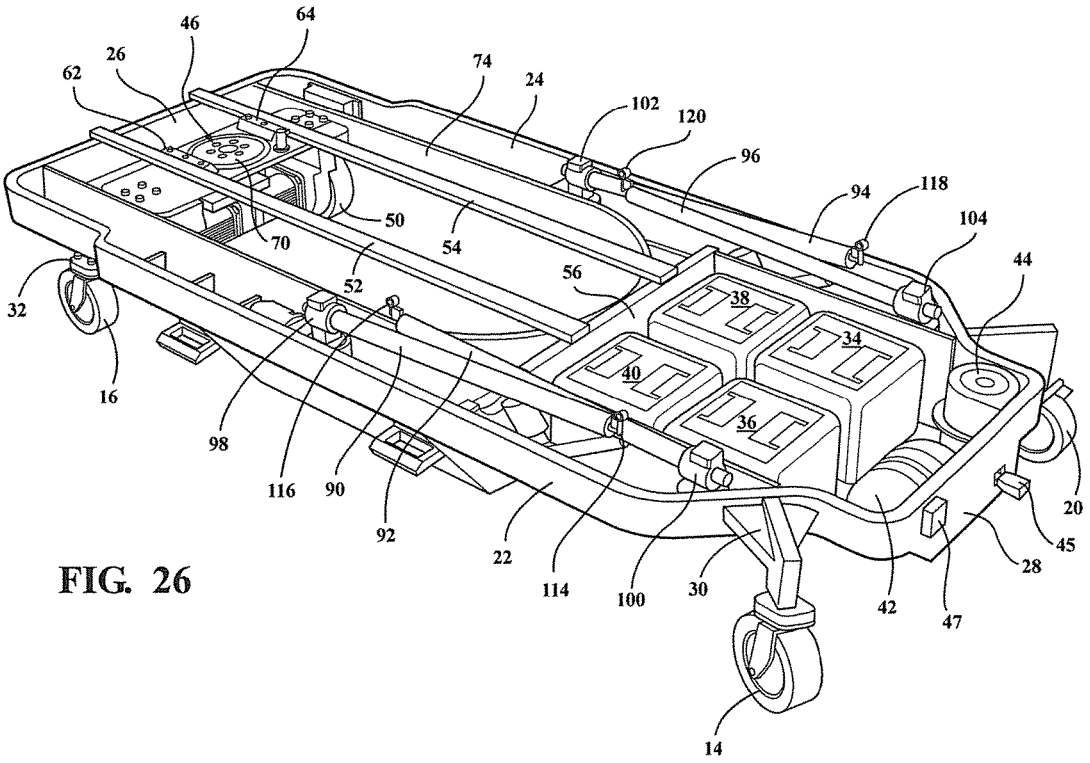
FIG. 26 is a further skeletal perspective of the base and illustrating a variety of drive components including such as multi-function electronic boxes, oxygen tank, connection cables, etc., and further depicting a plurality of corner located and outer passive rollers for assisting in multi-direction traverse-ability of the assembly.

As best shown in the skeletal view of FIG. 26, the base 12 integrates a variety of drive components including such as multi-function electronic boxes 34, 36, 38 and 40, oxygen tank 42 (or other fluid pressurized tank also contemplated to include hydraulics or other fluids), connection cables and associated windup housing 44 with externally accessible plug adaptor 45 secured to an end of a power cord retractable from said housing 44 and such as which can engage a suitable input location (see further at 47 in FIG. 26) to operably tether the motion of both first and second patient support surfaces associated with a pair of docked assemblies (see also FIG. 34) in a manner to facilitate patient transfer. Otherwise, the arrangement and type of powered components associated with the base is understood to be easily modifiable and with the understanding that additional or other components can be integrated into the assembly without departing from the scope of the invention.

As shown, the boxes 34, 36, 38 and 40 are housing units embedded in the base chassis. They are plug-play by nature and contain various sub-systems to operate the product. In one non-limiting application, selected ones of the boxes 34-40 can be labeled as:

a) Main Electronic Control Unit (i.e. ECU)—acts as the brain of the product and coordinates/manipulates/orchestrates all automated functions;

b) Main Central Processing Unit (i.e. CPU)—processes all the functions activities;

c) Battery System—contains all the powertrain system. It houses the battery pack, BMS, invertor/convertor, junction box and charger for a 48V system;

d) Auxiliary Unit—contains the black recorder (to register all the operations carried out by the caregiver/patient/specialist), contain communication systems (i.e. WiFi, Bluetooth, radio) to connect with the institute's network.

In one application, the internal communication protocol established between the black boxes is coordinated via a CAN bus system. Each wire/cable used is shielded to avoid EMF/EMI interface. The drive train of the product (i.e. steering/braking/acceleration/de-acceleration) can further be enabled via a bi-wire system.

It is also noted that the storage tank is embedded in the chassis along with a retractable power cord and data-communication cable (i.e. used when the patient is being transferred and allows two beds to communicate during transfer (see as again identified at 44 and 45 in FIG. 26). In this fashion, the assembly can operate in a network centric fashion in which the drivetrain is based on an electric or other suitable motor design (i.e. two motors coupled together and attached to drive wheels. The motor allows for travel forward/reverse/side to side and zero turn features and it is also understood that an alternate drivetrain design can be substituted without departing from the scope of the invention. This can further include, without limitation, any drive system integrating a single motor controlling all the wheels, a pair of motors controlling the front and rear wheels, respectively, or a system with four motor for each of the wheels.

Figure 24:
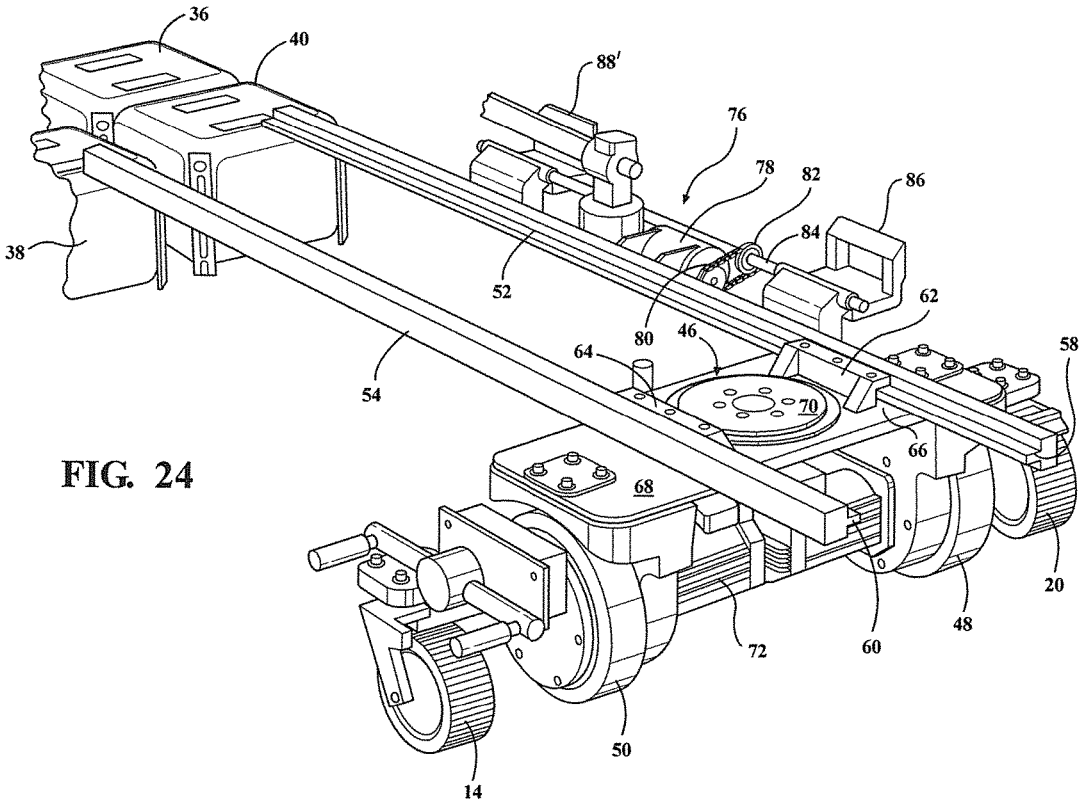
FIG. 24 is a partial perspective of a portion of the frame with propulsion system associated with the powered and mobile base in a first linear drive position, as well as a side located docking subassembly for inter-engaging first and second identical assemblies.

A propulsion unit, generally depicted at 46, is provided and includes a pair of opposite end supported drive wheels 48 and 50 (see as best shown in FIG. 24). The propulsion unit 46 is shown in a forward drive position in FIG. 24, and in which it is at a generally rear-most aligned location relative to the spaced apart rollers 14 and 20. A pair of interior spaced and linear extending rails 52 and 54 are built into the frame extending between end 26 and an intermediate inner and width extending support 56 as depicted in FIG. 26.

Figure 27:
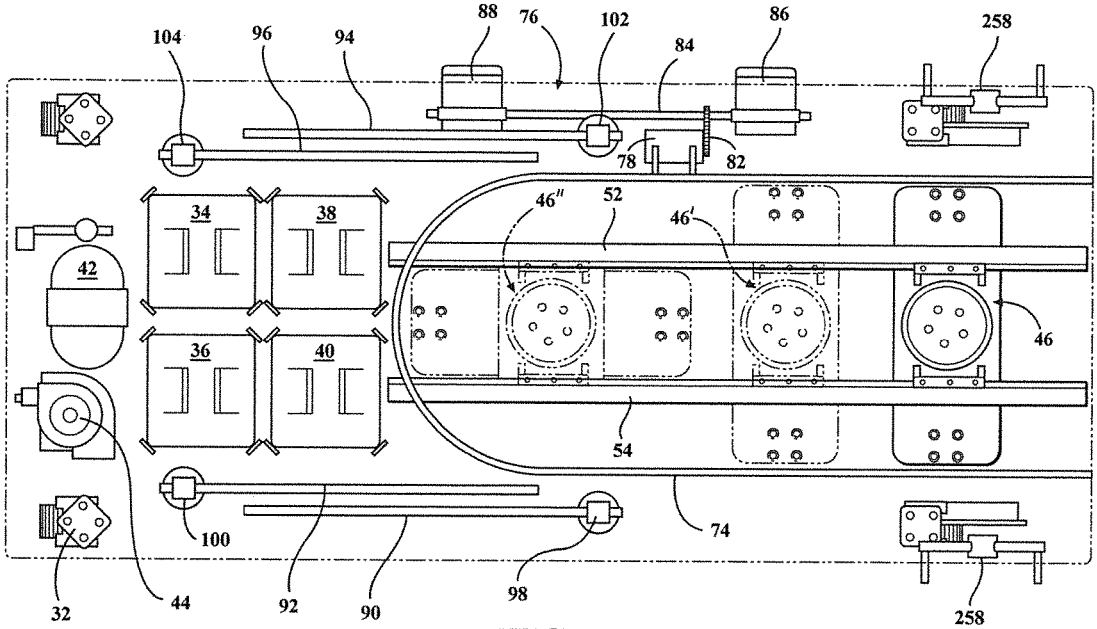
FIG. 27 is an overhead schematic view of the base and illustrating a number of the drive components identified in FIG. 26 along with the multi-position adjustability of the propulsion unit between linear and lateral drive positions.
Figure 28:
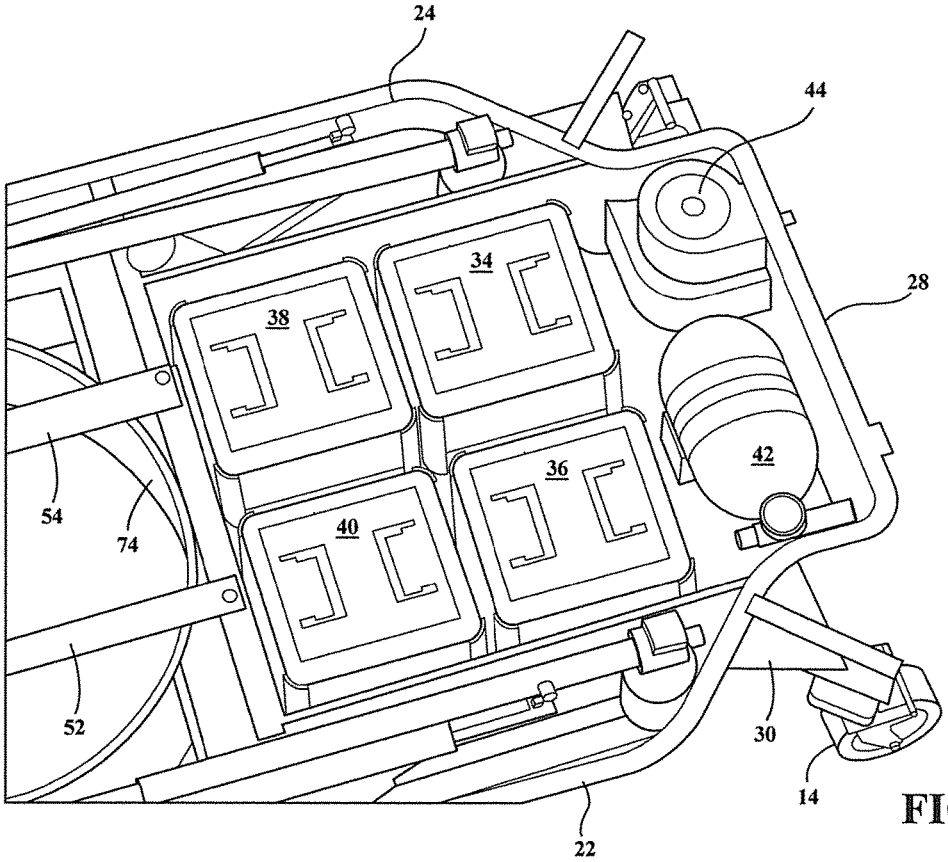
FIG. 28 is an enlarged partial perspective of the subsystems components as arranged within the base.

The rails 52 and 54 exhibit a generally polygonal (square) shape in cross section, again FIG. 24, and each includes an inner projecting ledge, further at 58 and 60, which is designed to seat and traversably support an outer facing recess or slot associated with each of a pair of flanges 62 and 64 secured to a top of the propulsion unit 46. In this manner, the propulsion unit 46 can be repositioned both linearly along the rails 52 and 54 (see intermediate linearly displaced position 46' in FIG. 27) as well as being further linearly/interiorly displaced and rotated to a 0 degree position as depicted at 46" (see each of FIGS. 25 and 27) at which the propulsion unit is reconfigured at a generally intermediate and sideways rotated position in order to enable the base 12 to be laterally displaced, this such as during docking with a second similarly constructed assembly and as will be described in further detail with reference to FIGS. 31-34.

The construction of the propulsion unit 46 is further such that the upper end supporting flanges 62 and 64 are mounted to a top plate 66 (FIGS. 24-25) which is non-rotatable but traversable along the rails 52 and 54 between the initial 46, first linearly displaced 46' and second displaced/rotated 46" positions. An inner perimeter defining circular profile is formed in the top plate 66 and is generally hidden in the series of assembled views 24-27 of the propulsion unit.

An outer plate 68 (see again FIGS. 24-25) includes a top plate 70 which seats upwardly through the inner profile of the top plate 66 in a supported and rotational manner. The outer plate 68 in turn supports the associated components of the propulsion unit, including the outer wheels 48 and 50 and associated drive and control features for operating the unit 46, this further depicted in FIGS. 24-25 as integrated into a housing 72 rotatably mounted with and supported underneath the outer plate 68 in non-interfering fashion with the inner rails 52 and 54 and the remaining frame of the base, and with the housing 72 connected to the power supply integrated into the base.

Figure 24A:
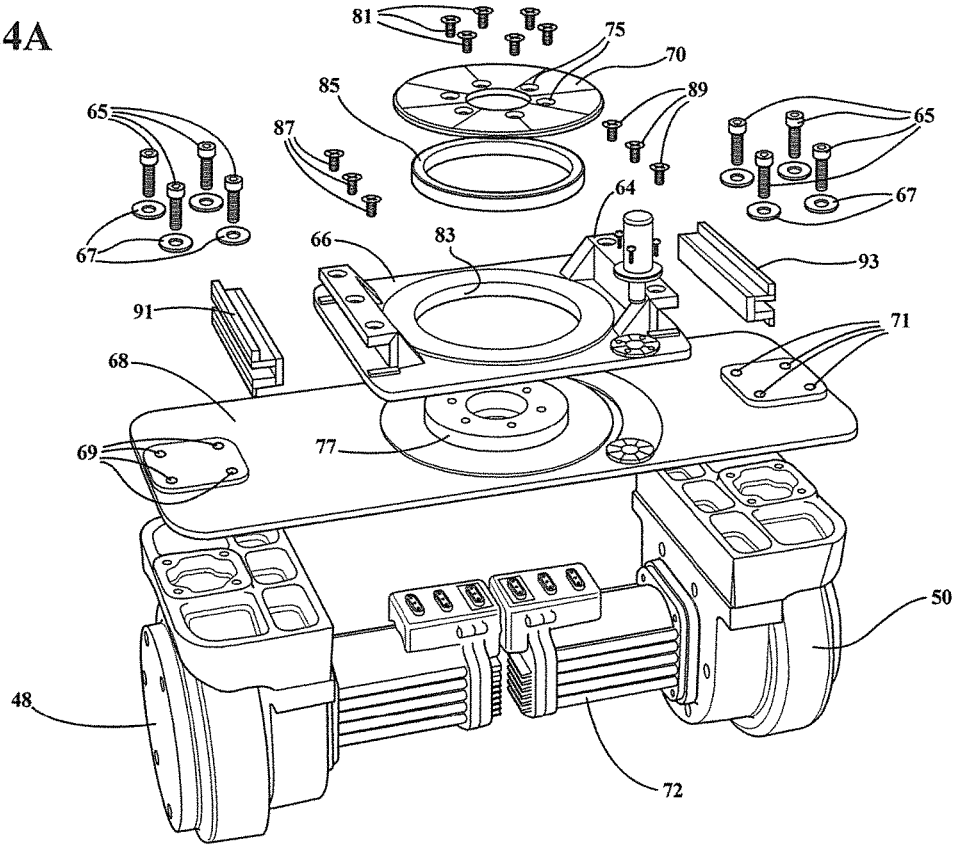
FIG. 24A is a first exploded view of the propulsion system.
Figure 24B:
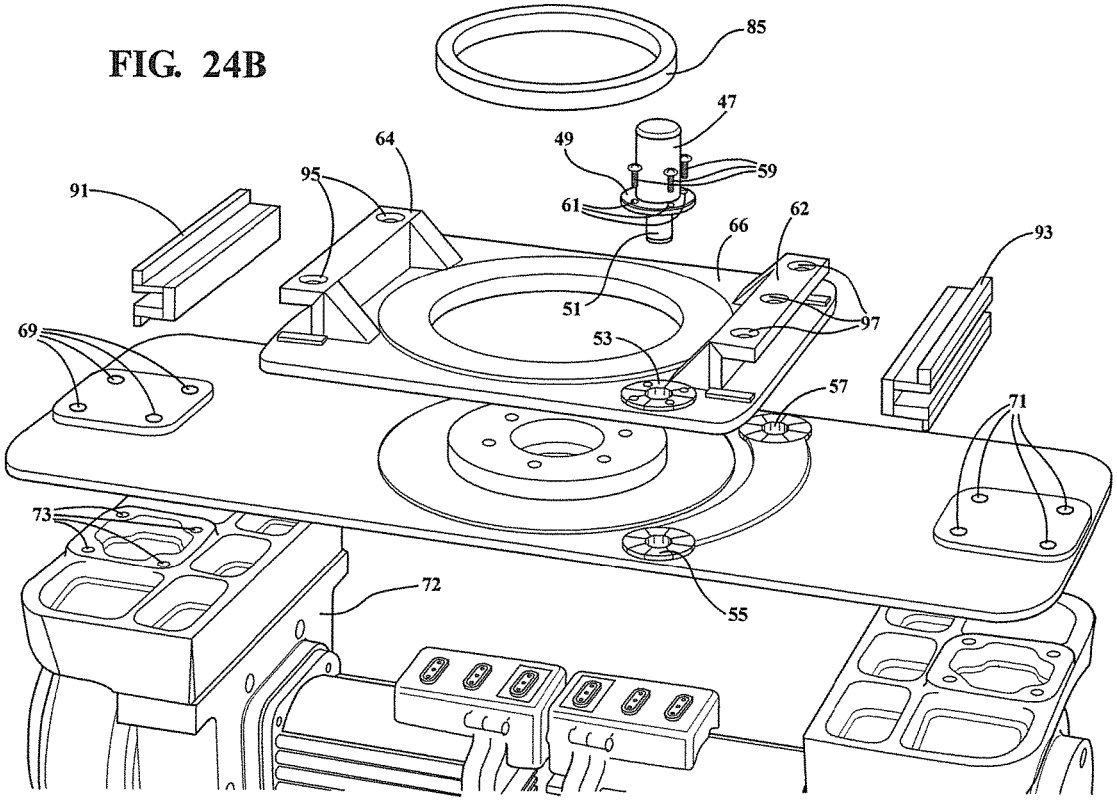
FIG. 24B is a further enlarged and rotated exploded view of the propulsion system and which further illustrates the retractable pin and arcuate track defined between the top and outer plates for accomplishing the 90° rotation of the propulsion system between forward drive and lateral docking positions.

FIG. 24A is a first exploded view of the propulsion system, with succeeding FIG. 24B a further enlarged and rotated exploded view of the propulsion system. Additional to the features previously identified, a retractable pin assembly is provided and which (as best shown in FIG. 24B) includes a main upper cylindrical shaped body 47, an intermediate annular ledge 49 and a downwardly and reduced diameter seating portion 51.

As shown, the pin assembly seats in projecting fashion through an edge proximate location of the top plate 66 defined by an inner annular/perimeter extending wall 53 which supports an end face of the annular ledge 49 and permits the reduced diameter pin to extend there through into aligned engagement with a first like shaped aperture 55 established at a first location of the outer plate 68. Upon upwardly retracting/unseating the pin assembly, the outer plate 68 is unlocked from the top plate 66 and is permitted to be rotatably actuated 90° to a crosswise position (see also FIG. 25) at which the pin 51 is reseated downwardly into a second aperture 57 in the outer plate 68.

As further shown, an array of pins 59 surrounds and seats circumferentially through perimeter aperture locations 61 within the annular ledge 49 and additional aligning locations 63 surrounding the perimeter location 53 in the top plate 66. Any suitable power elevating or retractable input, such as including an EM (electromagnet) or other suitable structure, can be employed for elevating the pin assembly such that the lower/reduced diameter portion 51 retracts from engagement with the either of the apertures 55 or 57 in the outer plate 68, and to thereby permit the outer plate to rotate between the operating positions depicted in FIG. 27.

Assembly of the outer plate 68 to the underneath located drive housing 72 is facilitated by first and second identical pluralities of bolts 65 and washers 67 which seat through aperture arrays 69 and 71 at locations approximate opposite sides of the outer plate 68. As best shown in FIG. 24B, the bolts 65 (which can be threaded along their stems) can rotatably inter-engage additional interiorly threaded locations associated with interior apertures 73 exhibited upon opposing upper faces of both first and second side locations of the drive housing 72.

The top plate 70 is best shown in FIG. 24B and includes a circular array of recesses 75. A circular projection 77 associated with the outer plate 68 includes an aligning array of recesses 79 such that bolts 81 secure the top plate 70 in overlaying fashion upon an central and inner rim 83 of the top plate 66 with the circular projection 77 seating within the rim 83. A bearing collar 85 is shown and is sandwiched under the top plate 70 and coaxially between the annular projection 77 and the inner rim 83 to provide reinforcing and rotational support during actuation. Additional fasteners 87 and 89 mount inner rail receiving portions 91 and 93 to the upper end supporting flanges 62 and 64, see additional aperture patterns 95 and 97 in FIG. 24B, for receiving the frame supported rails 52 and 54.

In this fashion, the propulsion unit operates to selectively drive the base along with its outer (passive) rollers 14-20 and in either or both longitudinal or lateral (crosswise) directions. An elongated and "U" profile guide 74 is provided (see FIGS. 26-27) extending underneath the rails 52 and 54 from the rear end 26 to the intermediate and crosswise extending inner frame support 56, this in order to guide the rotation motion of the drive wheels 48 and 50 of the propulsion unit to the 0 degree docking position of FIG. 27.

Figure 25:
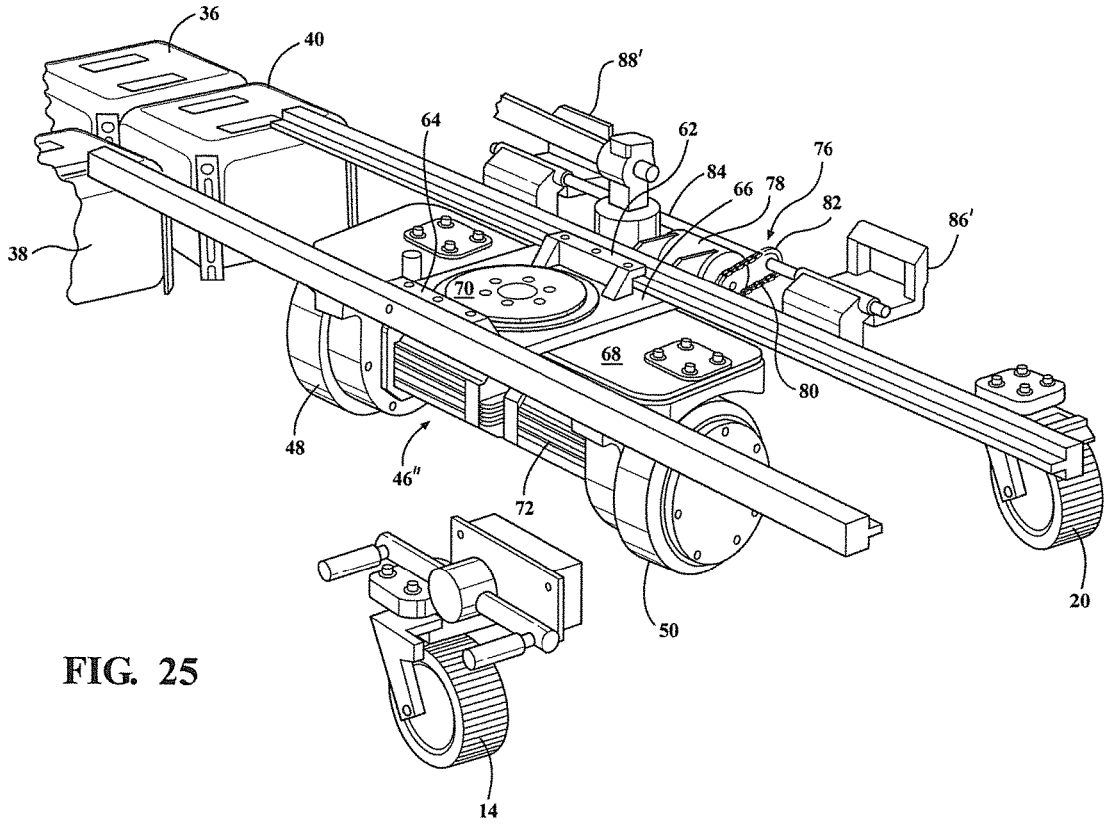
FIG. 25 is a successive view to FIG. 24 and illustrating the propulsion unit in a second position linearly advanced and rotated (0°) turn position for facilitate sideways/docking motion of the patient support and transport assembly.
Figure 31:
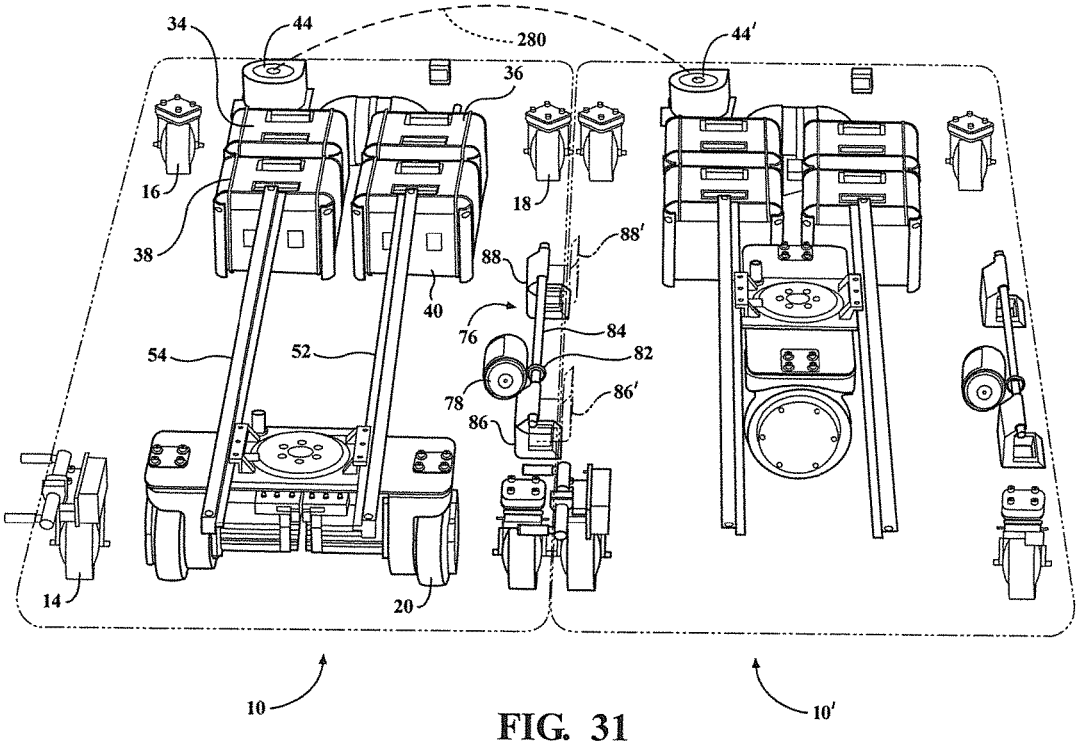
FIG. 31 is a schematic view of a pair of assemblies arranged in a side-by-side and docked configuration, enabled by the docking component associated with a side location of a first selected assembly and which is upwardly rotated to an engaged position with an opposing side of the second assembly.

As best depicted in the partial perspectives of FIGS. 24-25, this in combination with the schematic of FIG. 31, a docking subassembly is generally shown at 76 and is supported in proximity to a selected side 22 of the frame. The docking subassembly includes an electric motor 78, such as secured by an associated bracket to an exterior surface of the frame 22. A chain drive 80 (FIG. 25) extends from a take-off shaft of the motor and engages a gear 82 mounted to a linear extending shaft 84.

Although not shown, the shaft 84 is rotatably supported by suitable bracketry or like supports along proximate side locations of the frame. Also secured to the shaft 84 are a pair of "L" shaped and angled docking claws 86 and 88 which are actuated (see as best shown in FIG. 31) in a substantially ninety degree range so that the outer angled portions of the claws 86 and 88 are rotated, to positions 86' and 88', in order to engage inner facing locations of an opposing side frame portion (such as at 24 associated with an identically configured patient transport assembly as referenced at 31) in a side-by-side docking protocol as depicted in FIGS. 31-34. Also, and following a description of the remaining structure of the patient transport assembly, this including the patient support subassembly, a more detailed description will be provided of the various patient transfer protocols associated with succeeding illustrations FIGS. 32-34.

As will be described in combination with the succeeding description of the telescoping lifts and interconnecting and inter-articulating planar support sections which collectively define the patient support surface, the base 12 provides a weighted and very low center of gravity pedestal necessary for both supporting the patient and permitting reconfiguring of the patient support surface in each of horizontal/planar (FIGS. 1-7) and tilted (FIGS. 17-19) positions, and in addition to various inter-articulating (FIGS. 8, 9 and 12-16) positions. As further illustrated throughout the drawings, first and second pairs of crosswise supported and telescoping lift cylinders are provided in pivotally supported and first and second side proximate positions of the base. These are depicted by a first pair of telescoping or otherwise extensible supports 90 and 92, located in opposing and crosswise fashion proximate the side 22, and by a second similarly arranged pair of telescoping or like extensible supports 94 and 96 located proximate the other side 24 and in generally longitudinally aligning fashion with the first pair of telescoping supports.

As best shown by a comparison of FIG. 26 with FIG. 1 et seq., each of the telescoping supports includes an outer tubular portion (again depicted by each of 90-96), each of which are pivotally secured at 98, 100, 102 and 104 (see FIG. 26) to inside frame locations of the base. Hidden from view in FIG. 26 are the inner and extensible tubular portions and which are best depicted at 106, 108, 110 and 112 in FIG. 12.

Fluid lines (not shown) extend within the interior of the frame structure from the pressurized air tank 42 to a communicating location with each of the telescoping supports 90, 92, 94 and 96 and, in combination with associated electrical/pneumatic switches, cause the telescoping supports to be selectively or cooperatively actuated in a number of different possible configurations as will be subsequently described. It is further noted that the pressurized tank 42 is designed in one variant to hold an inert fluid that reacts to electrical pulses which in turn changes a support profile associated with the surface supporting cushions and sensors further described in reference to FIGS. 29-30.

As again shown in FIG. 26, each extending end of the inner tubular portions 106, 108, 110 and 112 is configured with an articulating permitting fitting, see further at 114, 116, 118 and 12. A patient support frame is generally referenced in plan view in FIG. 22 and includes a plurality of interconnecting support sections, these including a main upper body section 120, intermediate section 122, and pairs of lower leg sections 126 & 128 and 130 & 132.

Figure 22:
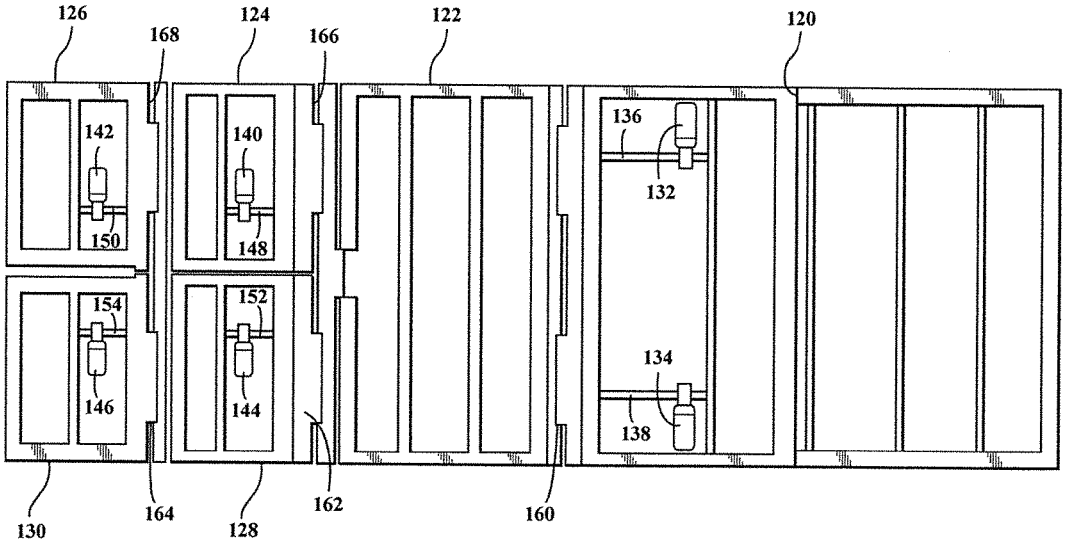
FIG. 22 is a plan view of the patient support frame.

As best shown in the underside perspective of the patient support frame in FIG. 22, the articulating nature of the underside frame engagement of the crosswise extending and lifting/lowering telescoping subassemblies is depicted by the articulating relationship (interpreted to include both pivotal and eccentric motion when required) established between the upper end extending fittings 114, 116, 118 and 120 of the telescoping tubular supports and respective engagement locations with the intermediate patient support section 122 and upper support section 120. Each of the individual frame sections 120-130 further includes a grid or other configured arrangement of inter-supporting members, as again best shown in FIG. 22.

Figure 23:
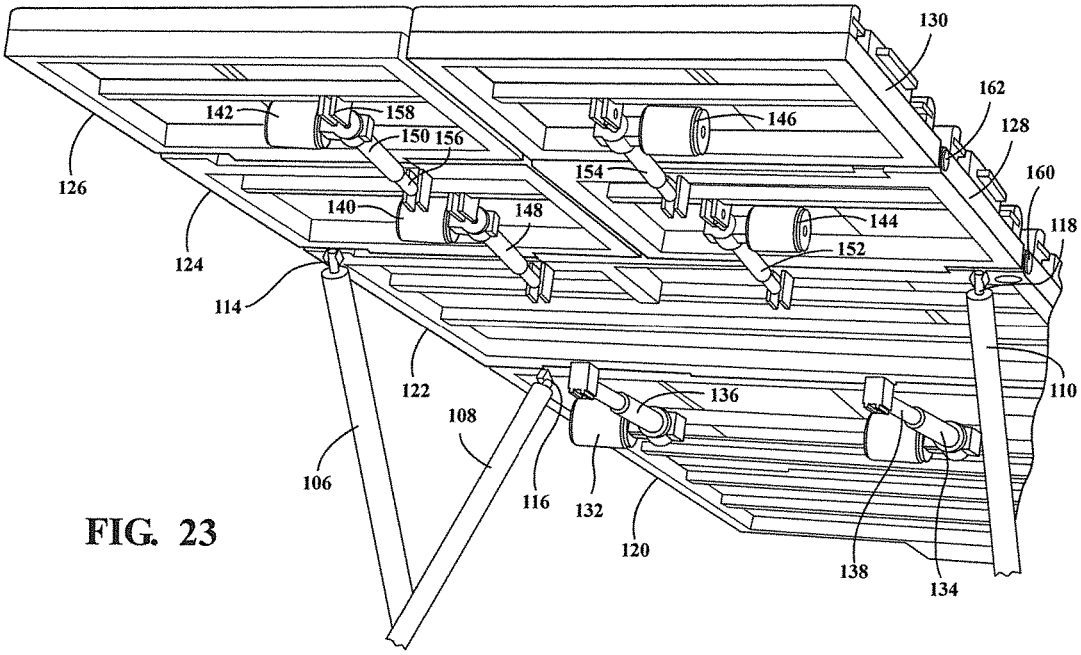
FIG. 23 is an underside perspective of the patient support frame in FIG. 22 and further illustrating both the articulating nature of the underside frame engagement of the crosswise extending and lifting/lowering telescoping subassemblies, as well as the configuration of the electric actuators in combination with additional telescoping and pivotally interconnecting components for achieving inter-articulating support between the individual patient support cushions/sections.

Also depicted are pluralities of electric actuators in combination with additional telescoping and pivotally interconnecting components for achieving inter-articulating support between the individual patient support cushions/sections. Referring to FIGS. 22 and 23 collectively, these are depicted by electric actuators 132 and 134 with corresponding telescoping/driving cylinders or supports 136 and 138 for pivotally re-adjusting the upper body frame section 120 relative to the mid-section 122. The pairs of leg support frame sections 124/126 and 128/130 are either inter-articulated or collectively actuated by additional located actuators 140 & 142 and 144 & 146, these along with corresponding drive cylinders 148, 150, 152 and 154.

As best shown again with reference to the underside perspective view of FIG. 23, each actuator and drive cylinder subassembly includes a two piece telescoping body including inner and outer tubular sections similar to that associated with the main telescoping lifts 90-96 and 106-112. As further shown, opposite ends of each of the inner and outer tubular members are pivotally mounted to locations associated with succeeding patient support sections (see for example at 156 and 158 for selected cylinder 150 in FIG. 23), such that pressurization of the drive cylinder 150 by the proximately mounted actuator 142 will cause a desired degree of bi-directional separation (in or out) in order to pivotally inter-adjust the patient support frame sections in any of a number of desired configurations as illustrated throughout the drawings.

Also depicted at 160 and 162 in FIG. 23 are articulation joints established between selected frame support sections 122 and 128 and between 128 and 130. Additional joints are provided at the extending edge interfaces between each of frame section and, as shown in the plan view of FIG. 22, this includes additional articulation joints 164 (between sections 128/130), 166 (between leg support sections 128/130), 166 (between intermediate section 122 and leg section 124) and at 168 (between leg support sections 124/126). On this point, it is noted that the hinge or joint 160 between upper section 120 and intermediate section 122 is continuous, whereas the individual hinge pairs 162/164 and 166/168 established between the leg support frame sections 124/126 and 128/130 enable the leg sections to be additionally and selectively inter-articulated in the fashion shown in FIGS. 12-16, this in one notable application to provide a maternity/birthing support platform.

For purposes of ease of clarity and presentation, a processor and appropriate input is associated with the electronic boxes and cabling to the various frame components, as well as for actuating the several patient frame support sections individually or collectively. Such a process and input controls is understood to operate in any of a number of defined fashions, such as remotely or wirelessly via a hand-held unit, however is also understood to include a hardwired control scheme easily accessed and operable from an access location associated with the patient support sub-assembly.

Figure 3:
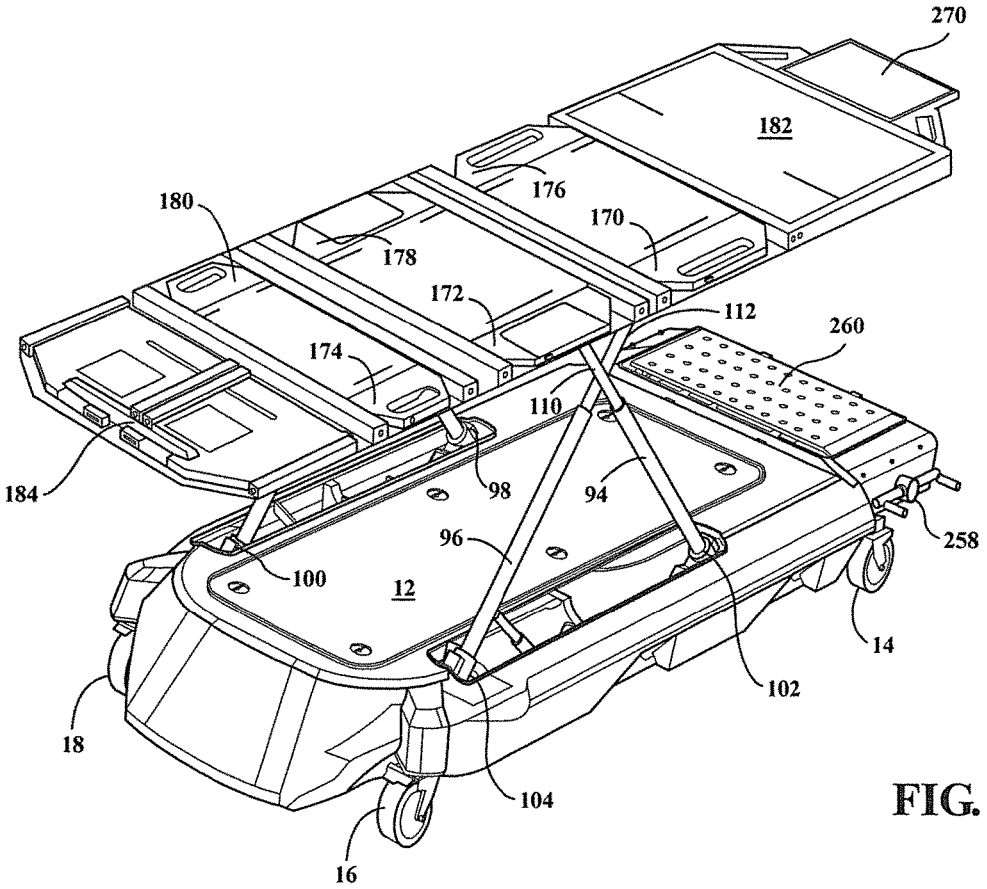
FIG. 3 is a further partially assembled view illustrating, in retracted position, the expandable side and end railings associated with the patient support surface.
Figure 12:
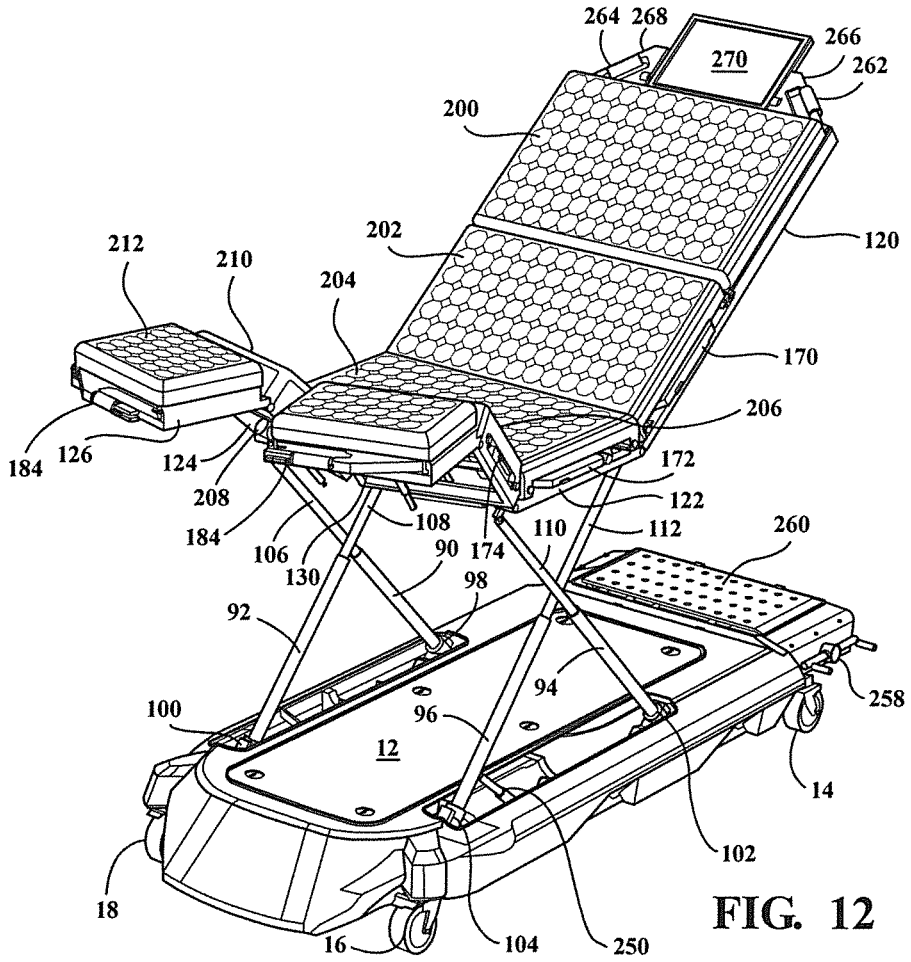
FIG. 12 is a perspective illustration similar to FIG. 1 and illustrating the patient support sections in a further inter-articulating arrangement which includes lateral (width extending) separation of the pair of lower/end most support sections in further articulated and leg supporting positions.
Figure 13:
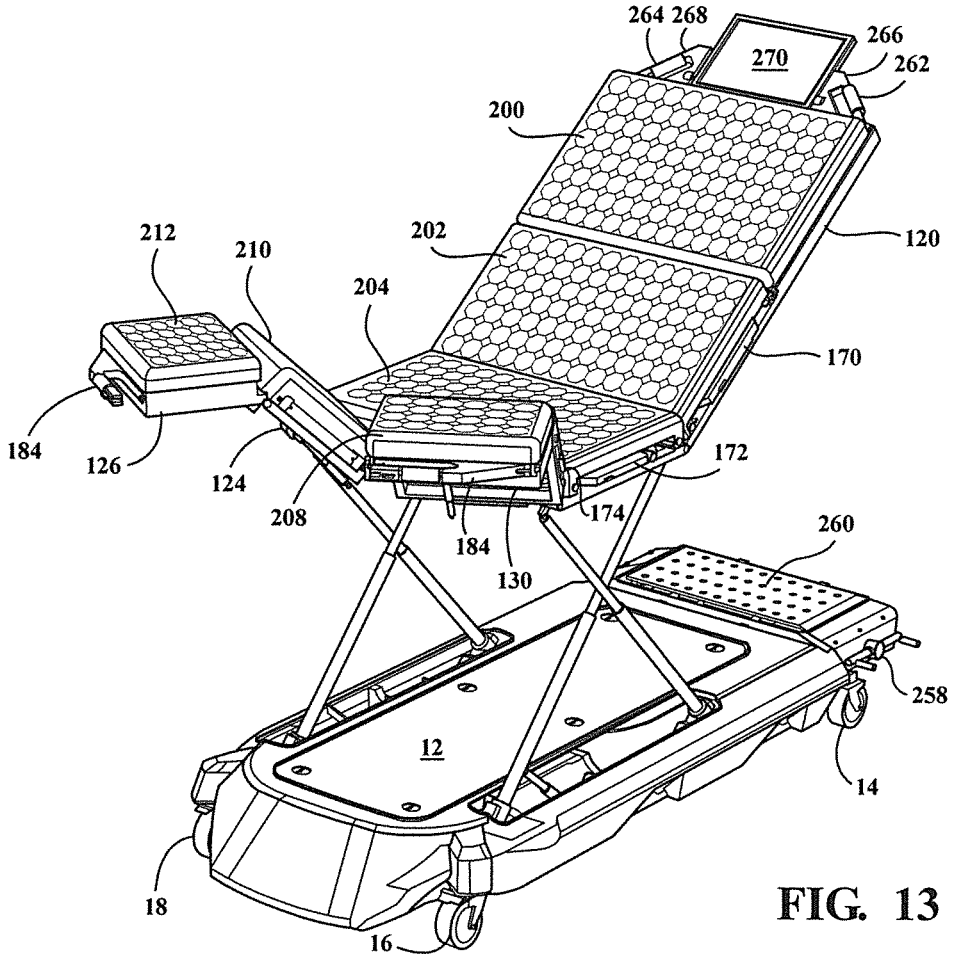
FIGS. 13 and 14 further succeed FIG. 12 and illustrate further lateral/articulating positions established by the leg support sections, such as in a maternal birthing position.

As best shown in FIG. 3, a plurality of expandable side and end railings are supported upon the patient support frame sections and are depicted in first retracted positions. Viewing FIG. 3 in combination with FIGS. 5-7, these include side railings 170, 172 and 174 on one side and 176, 178 and 180 on the other (these corresponding with patient frame sections 120, 122 and 124/128). Front end 182 and rear end 184 pull out rail sections are further shown, with the end railing 184 being configured as a pair of identical split sections owing to the ability to separate the leg support sections as shown in FIG. 12.

Figure 2:
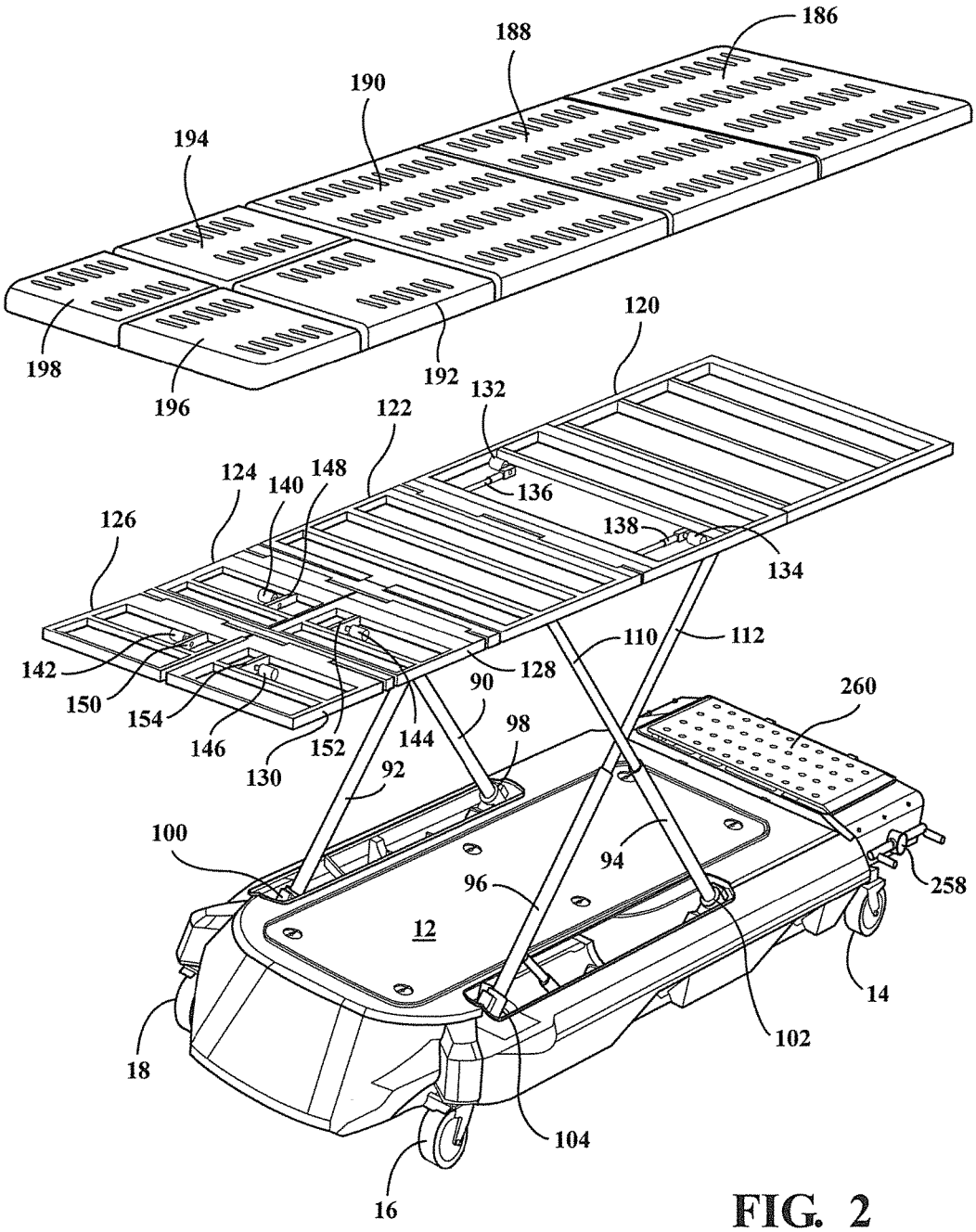
FIG. 2 is a partially exploded view of FIG. 1, with the sensor housed and patient support cushions removed, and depicting the plurality of intermediate support portions sandwiched between the upper cushions and the underlying patient support frame.

The pull out side and end railings each include upper and lower sections which are hingedly interconnected and which are supported in retracting fashion relative to a plurality of frame covering sections shown at 186 and 188 (for frame section 120), at 190 for frame section 122, at 192 for frame section 128, 194 for frame section 124, at 196 for frame section 130 and at 198 for frame section 126. As best shown in FIG. 2, each of the under surface frame covering sections 186-198 exhibiting a rectangular upper surface with a plurality of apertures for installing over the frame sections 120-130.

Figure 4:
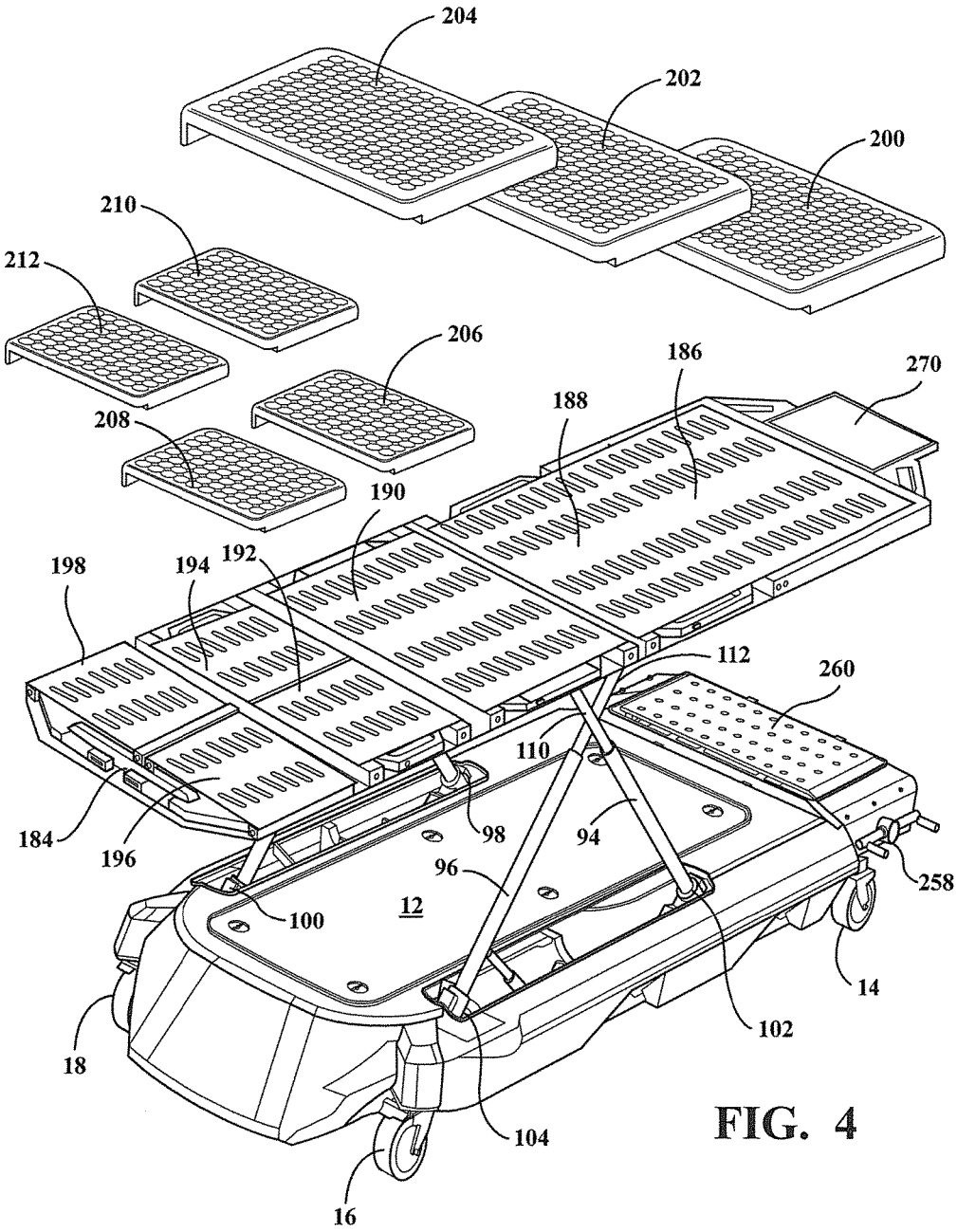
FIG. 4 is a further exploded view of the patient support sub-assembly combining the features respectively depicted in FIGS. 1-2.
Figure 5:
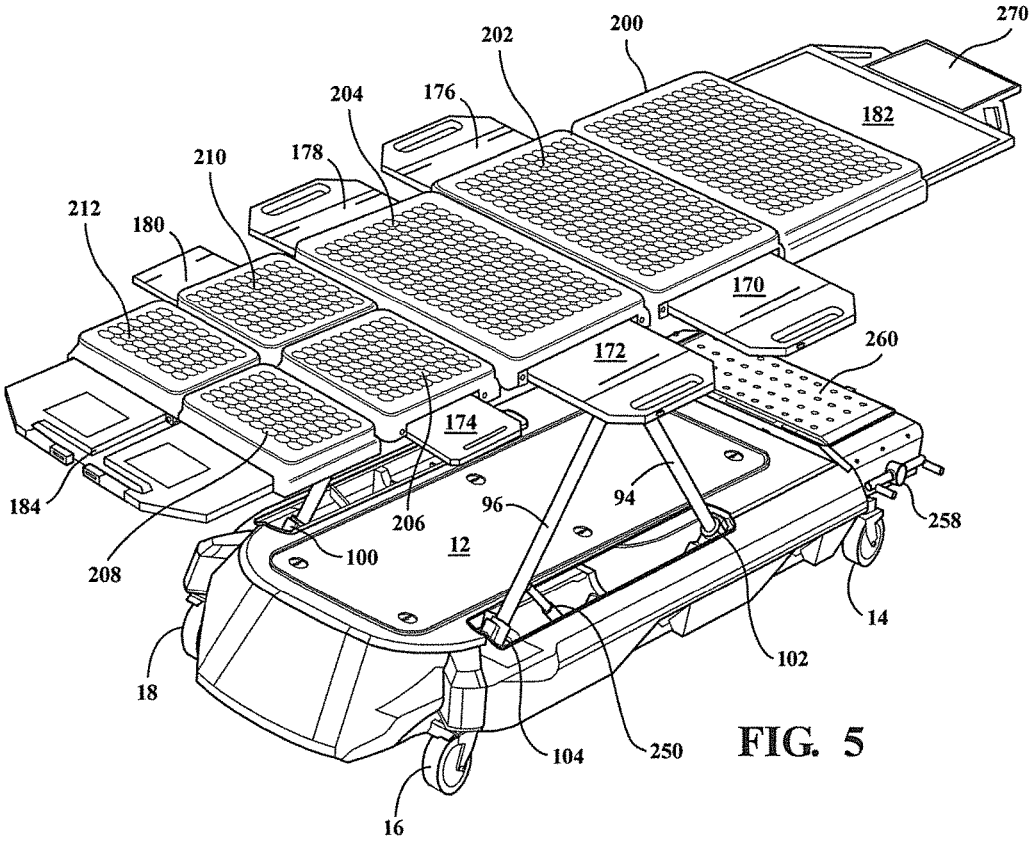
FIG. 5 is a succeeding illustration to FIG. 1 and depicting the side and end railings in first linearly extended positions through the side slot of each cushion housing.
Figure 6:
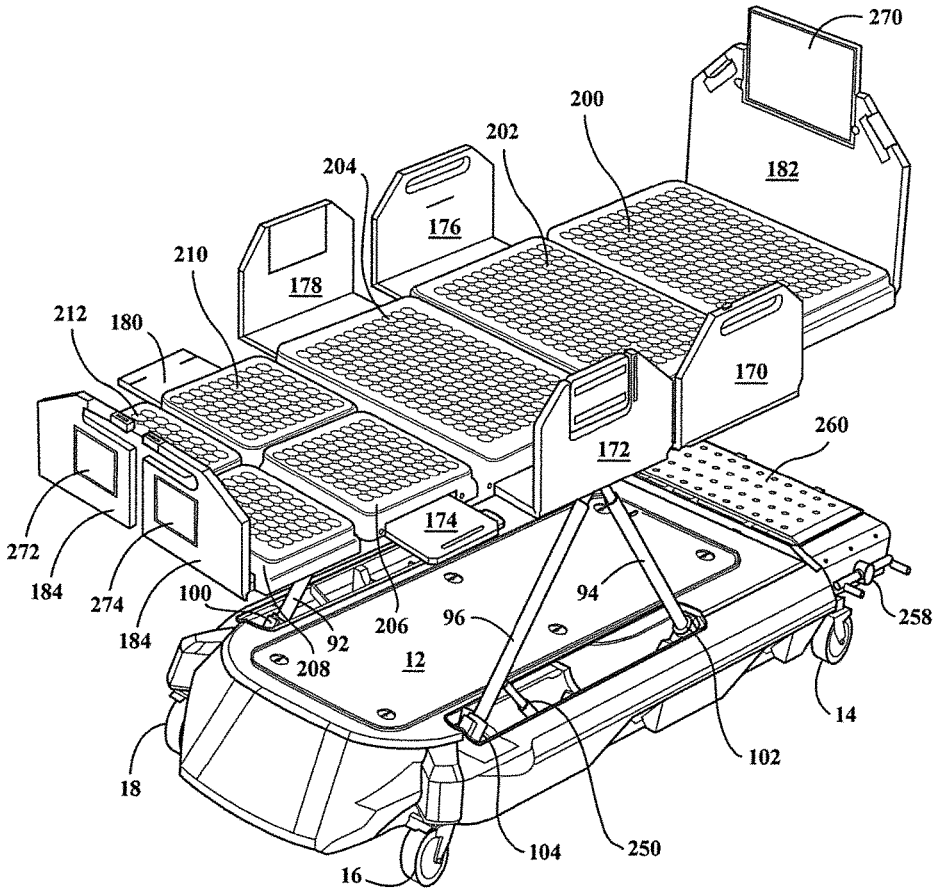
FIG. 6 is a succeeding perspective illustration to FIG. 5 and showing the outermost articulating portion of each slide-out railing in an upwardly pivoted position.

FIG. 4 best illustrates one arrangement in which the side railings 170-174 & 176-180 and end railings 182/184 are supported atop the under frame sections 120-130, with the covering sections 186-198 sandwiching the rails and further which permit the pull-out railings to be extended outwardly (FIG. 5) and subsequently pivoted upwardly (FIG. 6) along articulating hinges separating the upper patient restraint sections and lower connecting sections associated with each railing. Although not shown, a suitable locking structure can be employed for fixing the railings in their fully engaged positions of FIGS. 6-7.

FIGS. 1 and 4-7 depict a plurality of surface supporting cushion sections 200, 202, 204, 206, 208, 210 and 210 which generally align with and secure over the various frame covering sections 186-198, underneath located pullout side 170-174 & 176-180 and end 182/184 rails, and under-supporting frame sections 120-130. As shown, cushion sections 200/202 and frame covering sections 186/188 overlay upper patient frame section 120, with remaining cushion sections 204-212 corresponding with frame covering sections 190-198 and frame sections 122-130.

Figure 29:
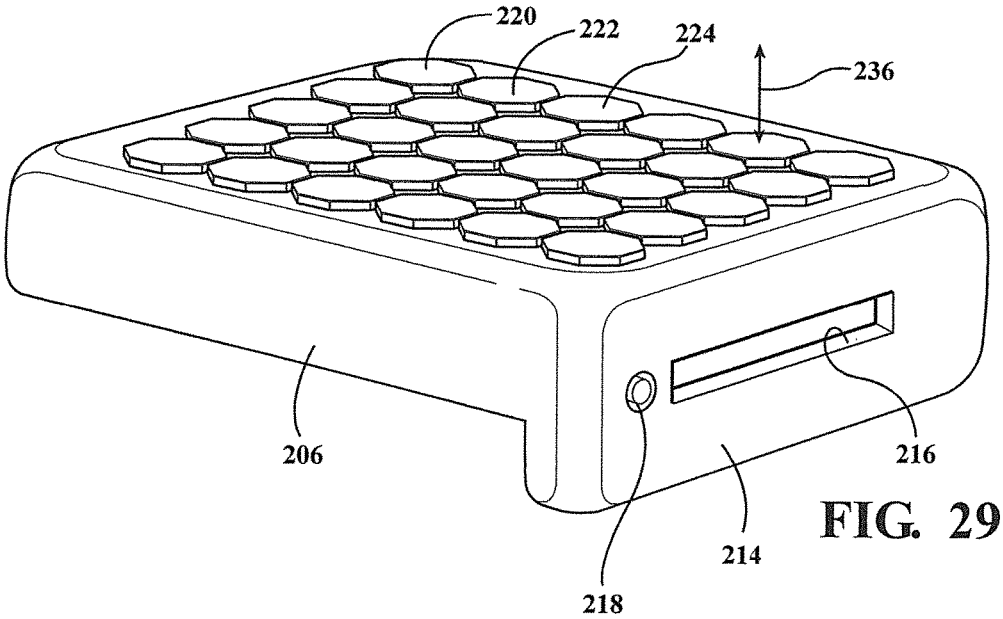
FIG. 29 is a sectional perspective of a selected patient support cushion with vertically adjustable cushioning sensors.

FIG. 29 is a sectional perspective of a selected patient support cushion 206, and which exhibits a generally rectangular and three dimensional configuration with a depth extended outer lip 214 which is configured to include a horizontal slot (see inner perimeter surface 216) for permitting extraction therethrough of the associated side pull out drawer or railing 174. An extension lock button 218 is depicted and permits pull-out extension of the selected rail 174 in the manner previously described.

Figure 30:
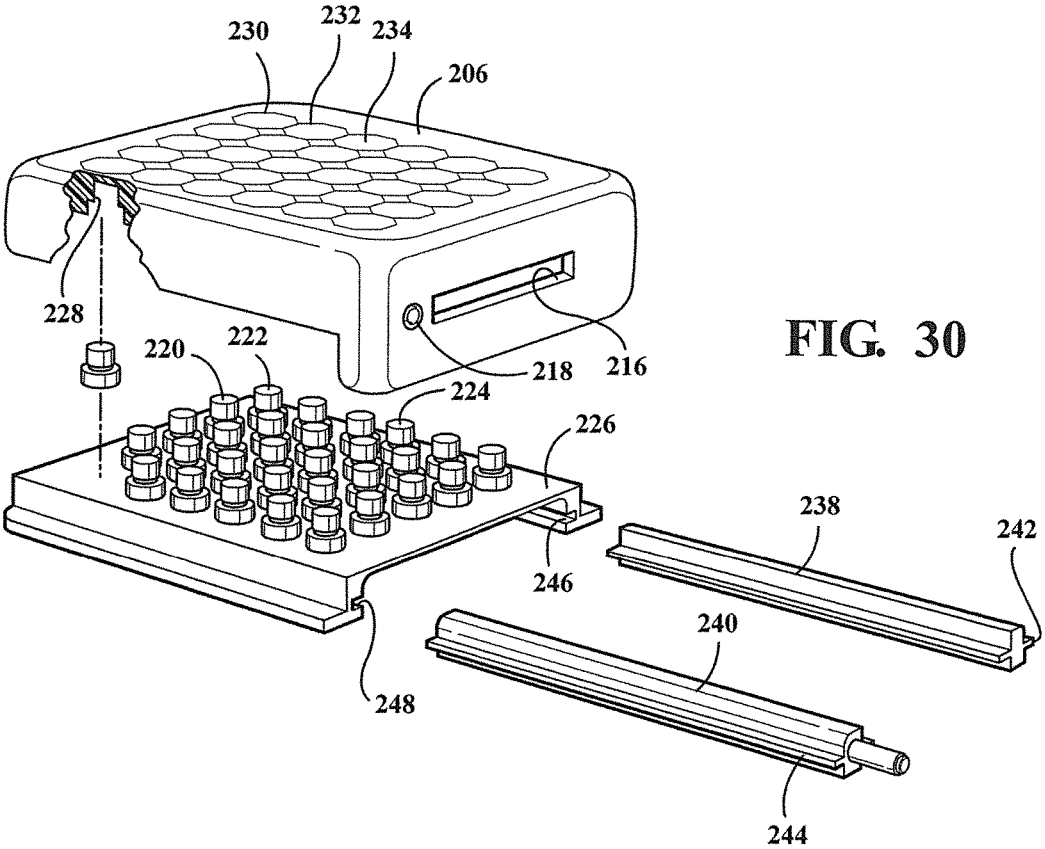
FIG. 30 is a succeeding exploded view of the support cushion and illustrating the multiple smart sensors arranged upon an interior mounting plate, which is in turn secured in sliding fashion over a pair of rails associated with the patient support frame.

As also depicted in succeeding exploded view of FIG. 30 is an exploded view of the cushion 206 and within which is supported a plurality of individual patient support (smart) sensors 220, 222, 224, et seq. The sensors are secured upon a durable aluminum mounting plate 226 over which is assembled the cushion 206, which further can exhibit a plasticized or like durable construction and which includes a pre-molded underside profile or seat 228 as shown in partial cutaway and which permits an uppermost portion of each sensor to project through an aperture 230, 232, 234 et seq. configured in the upper surface of the cushion 206. As will be further described in additional detail, the smart panels (i.e. mattress) and the associated sensors assist in reducing or eliminating muscle atrophy, poor blood circulation and bed sores so to reduce blood clots.

As further shown, the sensors are internally spring loaded or otherwise individually pressurized such that an uppermost portion of each projecting above the apertures in the cushion is vertically displaceable (see bidirectional arrow 236 in FIG. 29) in a fashion which provides a measure of patient support and cushioning. Additionally, the sensors can incorporate various types of smart technology and may interface with processor inputs either on-board the patient transfer assembly or remotely activated (such as again wirelessly) for providing such as massage, therapeutic or other suitable functionality.

In one embodiment, the surface technology employed with the present invention is made of up modularized smart panels (or zones). These panels are designed to be "plug and play" in nature and to be attached to the articulating frame of the device. The panels contain all sensors receivers and embedded electronics (i.e. these being "sandwiched" together).

In a further desired configuration, the panels are secured with a quick-disconnect/release connector to the chassis. All data (such as is collected in real time) from the sensors is transmitted to an associated central processing unit (CPU) via a communication network. Although not shown, the sensors as described herein are arrayed in such a fashion that they are embedded by a medical grade inflatable bladder-like material, with the bladder operable to inflate/deflate via a number of known technologies including but not limited to electro-magnetic technology. The individual sensor containing panels (or cushions) as described herein can be programmed to work in sequences or randomly to change the profile of the panel when critical events occur. In application, a standard bed sheet can be fitted over the top surface defined by the collective panels.

Additional considerations include the sensors being multi-functional in nature and which can provide output directed relating to any or all of measurement, pressure (provides data on load/force and firmness of the panel and determine if patient is out of bed/fallen or tipped out) and temperature (provides climate data to adjust a panel temperature (increase heat or cool as needed for patient comfort and senses a patient's body temperature). Capabilities of the sensors can further include load cells which operate in aggregation in order to measure a weight of the patient in bed.

Additional sensor functionality and capability envisions the integration of moisture sensors (such as reading and outputting a signal correlated to a humidity input and provides data on the moisture in the panel created by the patient). Motion sensors can also be incorporated and which read such as vibration (provides automated stimulation), tilt+angular+pitch+roll (i.e. MEMS sensor system to control COG) and friction (provide data for patient transfer). Level sensors can also be utilized to measure such as a fluid level in the storage tank and which are utilized in combination with motion sensors placed on each bed railing for indicating movement of the bed rails.

Although not shown, a suitable wiring or contact structure can be employed for independently or cooperatively actuating or taking readings from any number of sensors, which are further designed to be easily removable or replaceable from the mounting plate 226 and this can include integration of snap-in connections or other quick connect structure. Also not shown is the provision of a flexible and fluid protection membrane which can be applied over the patient supporting arrangement of cushions such as shown in FIG. 1.

A pair of supporting rails are shown at 238 and 240 for mounting atop such as a selected one of the covering sections 192 and as best shown in FIG. 4. Each of the rail exhibits a laterally extending lip or ledge (see at 242 and 244 for rails 238 and 240) for providing sliding support of seating interior facing recess profiles 246 and 248 associated with parallel and end extending pedestal locations associated with the mounting plate 226. Without limitation, the support plates, associated sensors, and outer cushions can be mounted in other configurations not shown in order to provide adequate patient support and to permit a cushion sub-assembly to be quickly detached from the patient support frame for ease of servicing or replacement of components.

Figure 11:
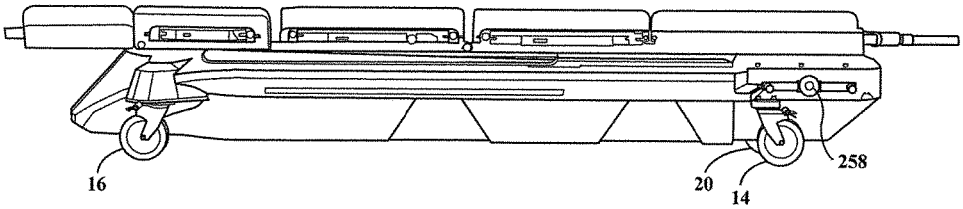
FIG. 11 is a yet further fully collapsed illustration of the assembly and illustrating a minimum overall height such as which facilitates each of storage during periods of non-use.

Referring again to FIG. 1, the telescoping and patient lift supports can be further assisted by the incorporation of one or more auxiliary and reinforcing lift cylinders, and such as further being referenced at 250 in pivotally mounted fashion to both a recessed location of the base 12 and the indicated telescoping lift 96. The top surface configuration of the base 12 further exhibits a pair of side disposed and linearly extending channels (see inner surfaces 252 and 254) which seat the cross wise extending tubular supports 90/92 and 94/96 when collapsed from their most upright extended position (FIG. 1 which represents the patient support surface at a height typically but not limited to 42" from a ground surface) to a fully collapsed and non-use or storage position shown in FIG. 11 in which retracted and lowered tubular supports are seated within the recessed extending sides of the base 12 and the top surface of the patient support sub-assembly is reconfigured to a minimal height (such as typically but not limited to 12" from the ground supporting surface).

Figure 9:
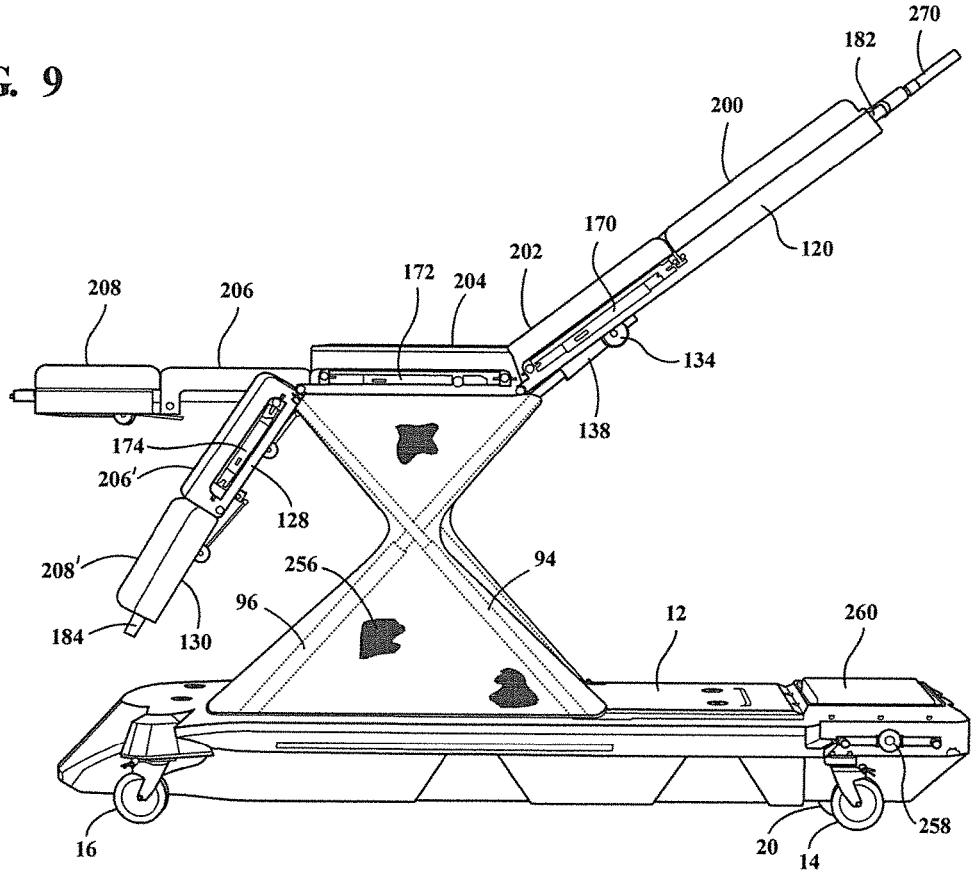
FIG. 9 is a succeeding illustration to FIG. 8 and depicting a pair of lower/end most support sections in further articulated positions, as well as showing the application of a flex covering or sheath applied over the pairs of cross-extending telescoping subassemblies which extend upwardly from a traversable base module, the telescoping subassemblies engaging, in articulating fashion, underside locations of the patient support frame.
Figure 10:
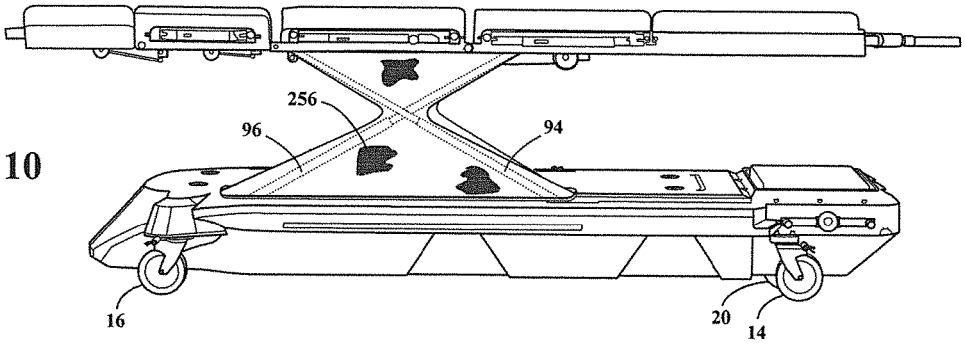
FIG. 10 is a further side illustration of the assembly in an intermediate collapsed position and which further depicts the ability of the side located telescoping sub-assemblies to selectively elevate/lower the patient support frame relative to the base module.

FIGS. 9-10 further depict a stretch fabric 256 of suitable construction which can be installed between the underside of the patient support frame and the upper surface of the base 12, such as shown in reference to selected pair 94 and 96 of cross wise extending telescoping supports, and which provides advantages including both neatness of appearance as well as helping to prevent interference of outside objects with the path of travel of the supports. It also provides a water tight membrane to allow for standard "wash down" procedures. A dual position tilt pedal 258 (see FIG. 1) is further depicted and which can provide either powered or manual pivoting of the patient support surface in the succession of end views shown in FIGS. 17-19, and in which the multi-articulating aspects of the tubular supports are shown with respect to their underside engagement with the patient support frame sections.

Figure 20:
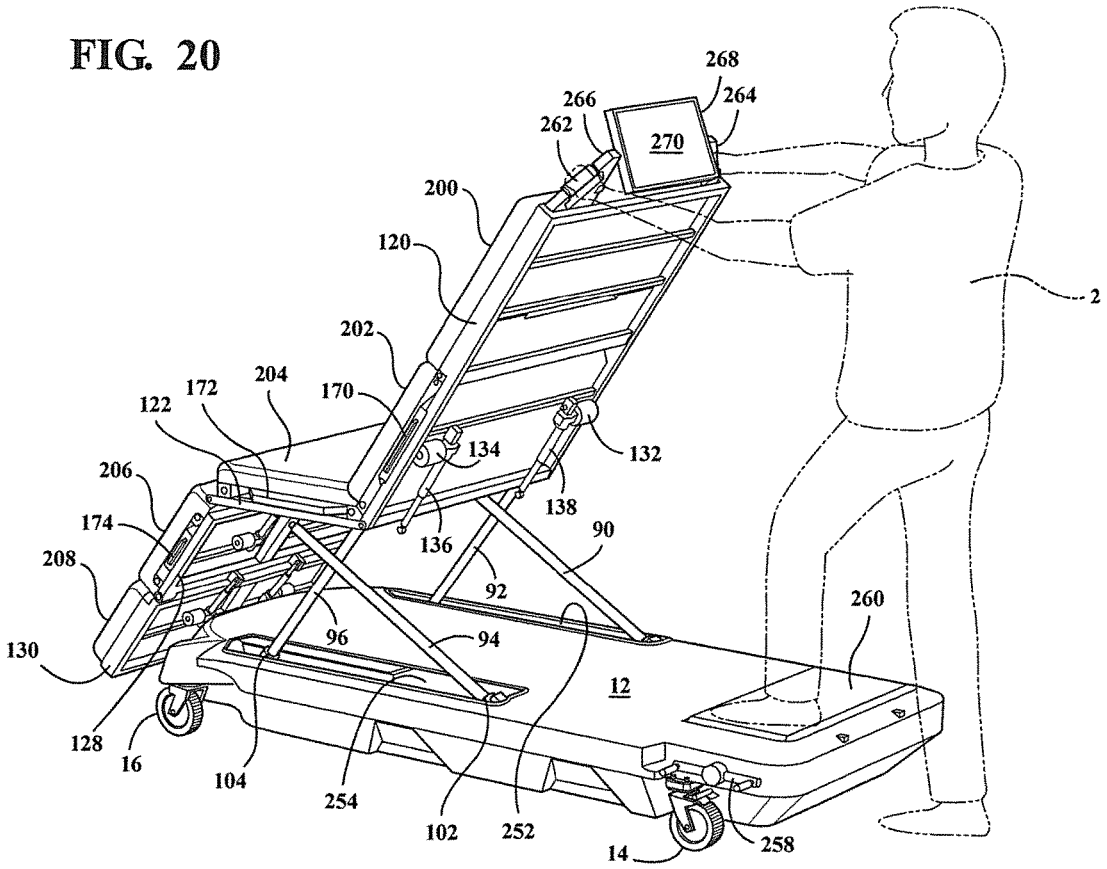
FIG. 20 is a succeeding illustration in perspective similar to that shown in FIG. 9 and depicting the assembly in an operator and pedestal supported transport position.

A pedestal support location 260 is provided upon the base 12 and, upon converting the patient support surface to the configuration depicted in FIG. 20 (in which upper frame section 120 and supporting cushions 200 and 202 are angled upwardly with respect to the middle frame section 122 and with the lower leg supporting sections 124-130 and associated supporting cushion sections 206-212 being either angled downwardly as further shown at 206' and 208' in FIG. 9 or maintained level with the middle section 122), an operator 2 (in phantom) can step onto the platform 260 and grip a pair of twist grip throttles 262 and 264 which extend in angular fashion relative to supporting locations 266 and 268 configured at the end of the upper body frame section 120.

Figure 7:
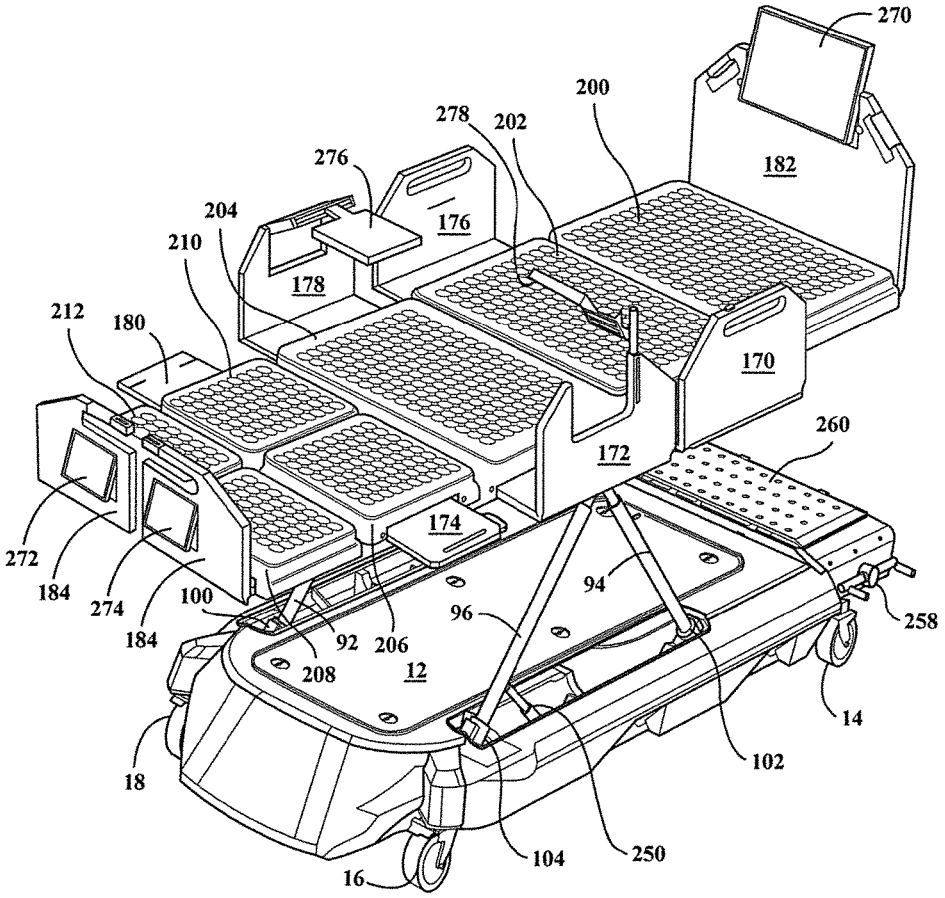
FIG. 7 is a further succeeding illustration to FIG. 6 and depicting the pivotally adjustable head and foot located display screens, combined with the side illustrated diagnostic or support components pivotally or otherwise supported upon selected railings in the engaged position.
Figure 8:
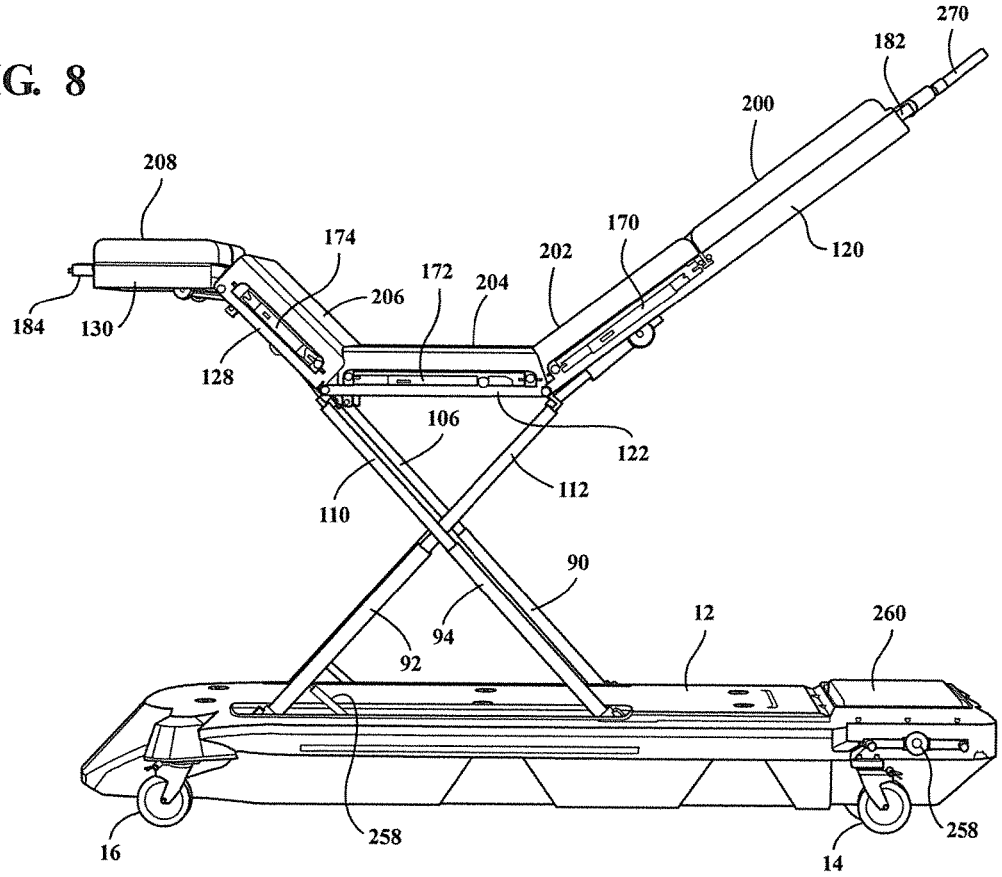
FIG. 8 is a side view of the patient support and transport assembly in a first non-limiting and non-planar articulating configuration enabled by electric actuators which engage the various patient support sections interconnected along articulating joints.

An operator screen 270 is depicted, located between the twist grip throttles 262 and 264 and which is rotatable from an initial position shown in FIG. 1 to provide an operator screen display for enabling the user to propel the assembly. As an aside, and referring to FIG. 7, secondary tilt screens are shown at 272 and 274 mounted to the lower end located pull out rail 184 and which can be cooperatively wired into the electrical architecture (or wirelessly communicated) associated with the patient support assembly and associated diagnostic tools. Additional non-specific examples of diagnostic tools are also depicted in FIG. 7 at 276 and 278 and which, in a patient examination mode provide a variety of diagnostic and monitoring functionality to the assembly and to existing caregiver diagnostic equipment (not shown) wirelessly or via network connection.

Figure 21:
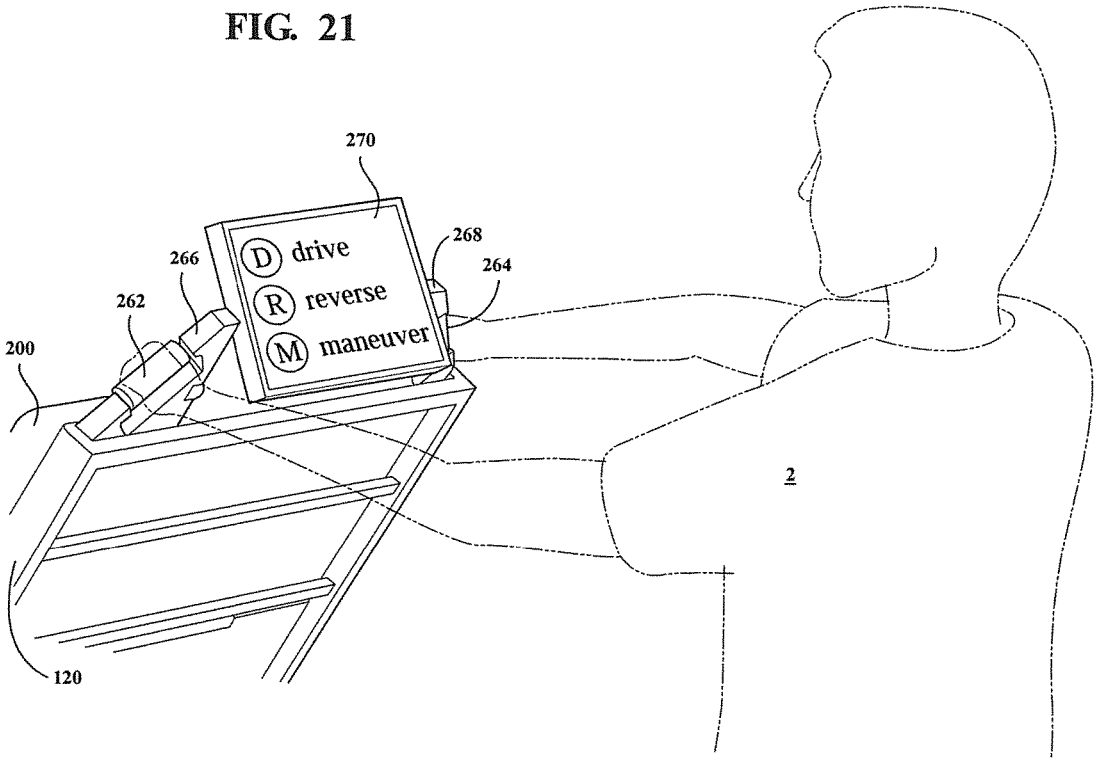
FIG. 21 is a succeeding and enlarged partial illustration of FIG. 20 and illustrating a pair of (head) end located twist grip throttles which, in combination with repositioning of a central and head located rotated screen which exhibits touch functionality, provides the operator with maneuverability of the self-propelled assembly and which can further integrate a camera or other sensor based collision avoidance system.

FIG. 21 is a succeeding and enlarged partial illustration of FIG. 20 and again illustrates the pair of (head) end located twist grip throttles 262 and 264 which, in combination with repositioning of a central and head located rotated screen 270 which is further depicted in a mode which exhibits touch functionality, provides the operator 2 with maneuverability of the self-propelled assembly. This is accomplished by the operator 2 accessing a software program, protocol and/or associated mobile application, which exhibits each of drive D, reverse R and maneuver M modes, these further capable of being selectively activated utilizing touch screen technology or the like.

In one non-limiting application, forward propelling motion of the assembly is accomplished by twisting both grip throttles 262 and 264 evenly and in the same (forward) direction. Left/right motion is further envisioned as accomplished by modifying the degree of twist of each of the throttles 262/264, such as either individually or with respect to each other. A collision avoidance system (not shown) can be integrated into the assembly such as utilizing cameras or other proximity sensing technology and in order to reduce the incidences of collisions.

Figure 14:
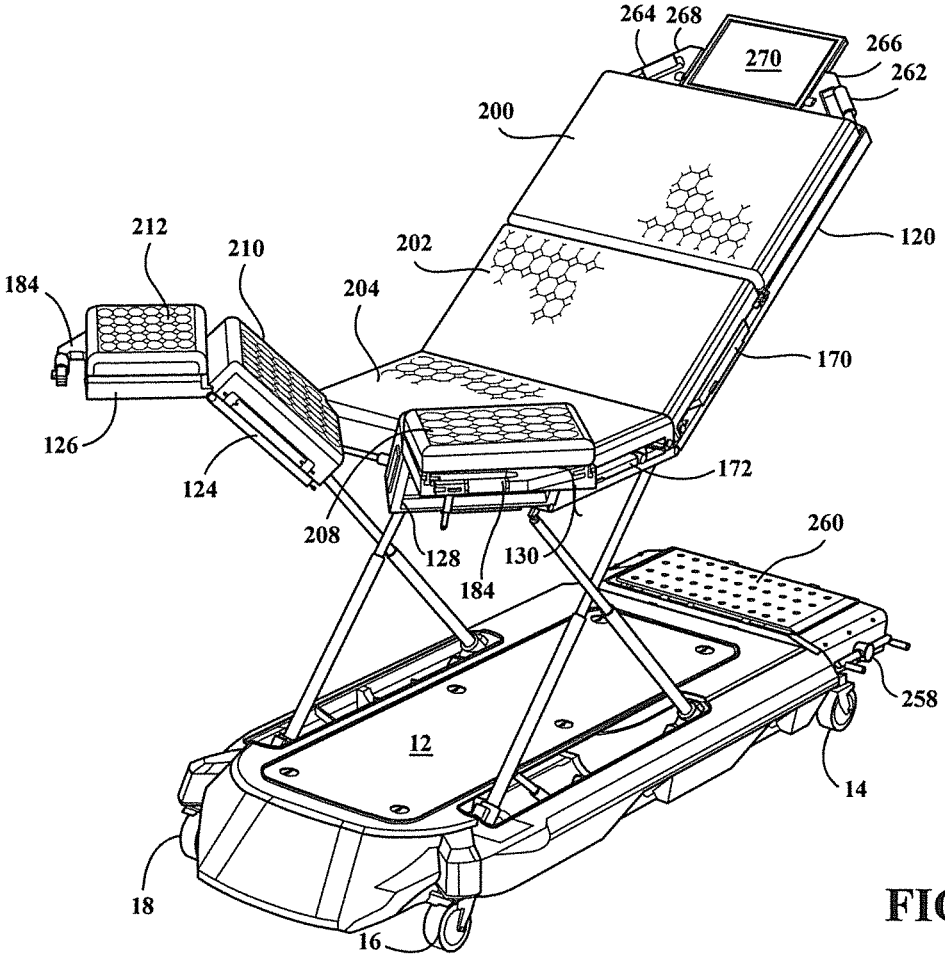
Figure 15:
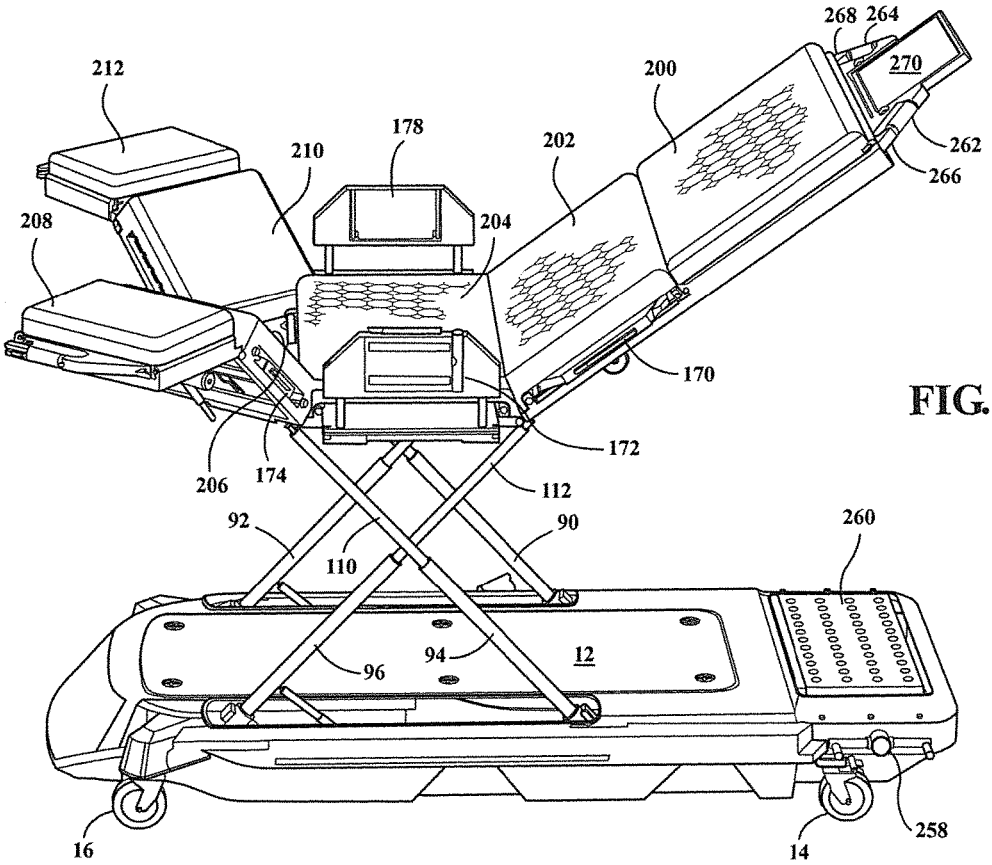
FIG. 15 is a side view and FIG. 16 a corresponding top view of the patient support and transport assembly in the reconfigured birthing or other medically related or benefitting position of FIG. 14 and depicting a pair of side disposed slide out trays in engaged position.
Figure 16:
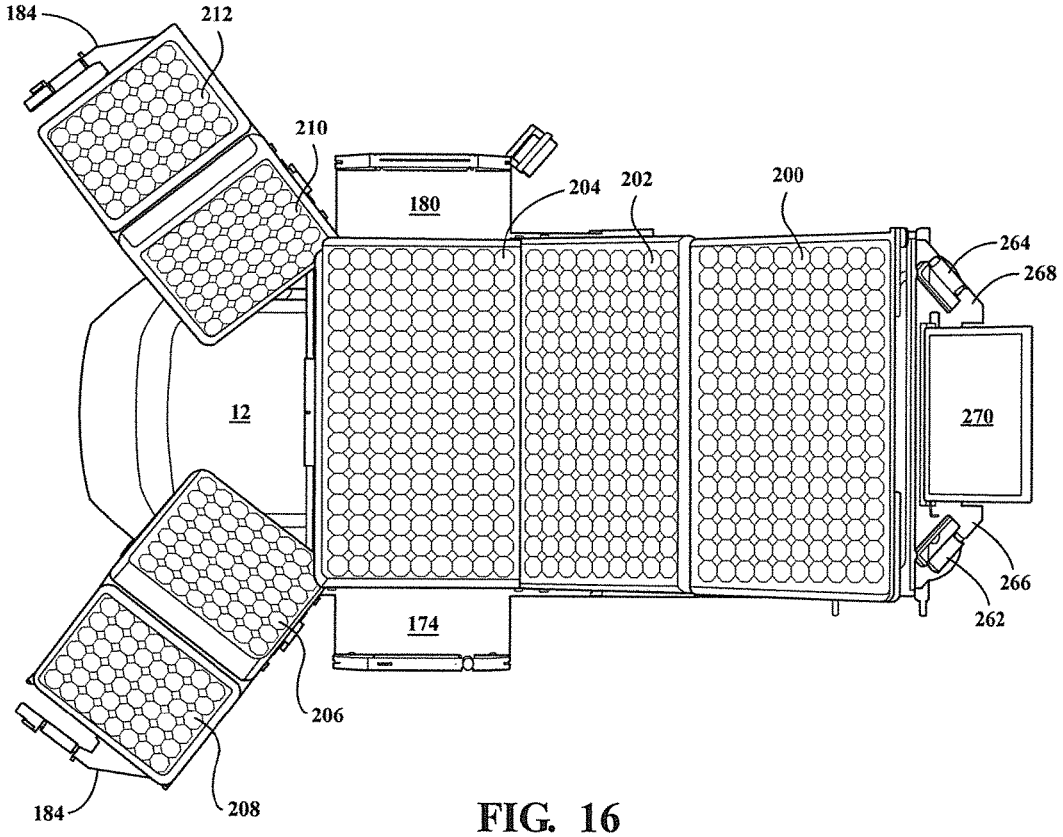

The progression of views depicted from FIGS. 12-16 illustrate further the lateral/articulating positions established by the leg support sections, such as in a maternal birthing position, with FIG. 15 being a side view and FIG. 16 a corresponding top view of the patient support and transport assembly in the reconfigured birthing position of FIG. 14 and depicting a pair of side disposed slide out trays 174 and 180 in engaged position. As previously described, the patient support functionality includes the ability to activate the individual actuators and drive cylinders associated with the varied and inter-articulating patient support sections in any manner desired in order to reconfigure the patient support from the flat configuration of FIG. 1 to any (inter) adjusted position such as depicted.

Figure 17:
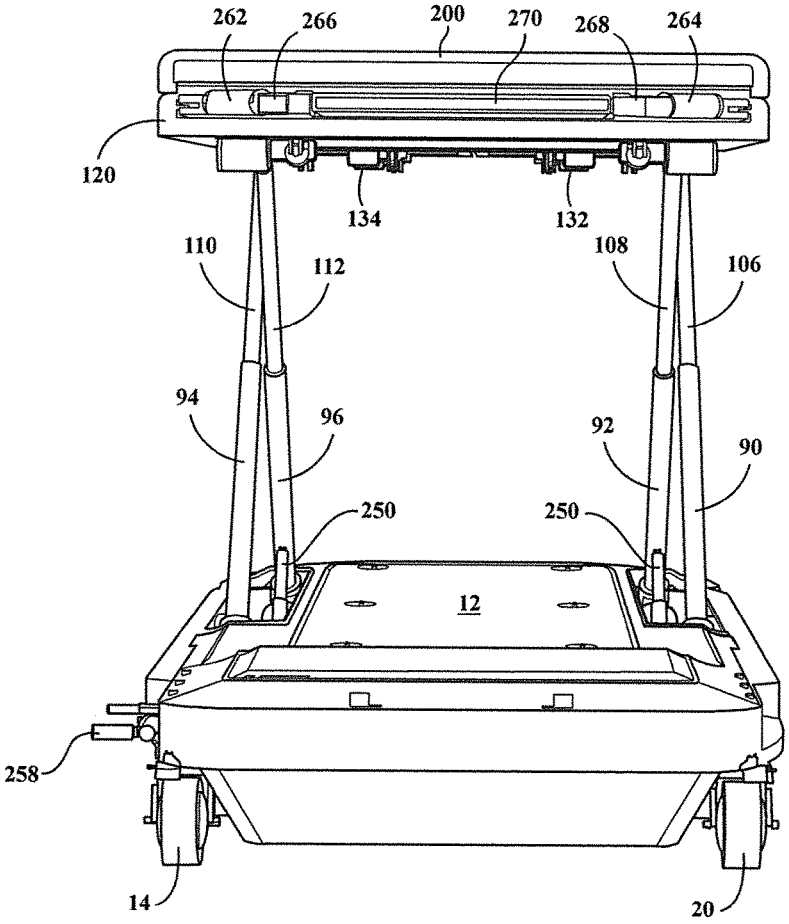
FIGS. 17-19 are end view illustrations of the patient support assembly and depicting reverse (side) tilted positions of the patient support surface which are enabled by selective actuation of the side supporting pairs of cross-extending telescoping subassemblies, these further articulating relative to underside supporting locations of the patient support frame.
Figure 18:
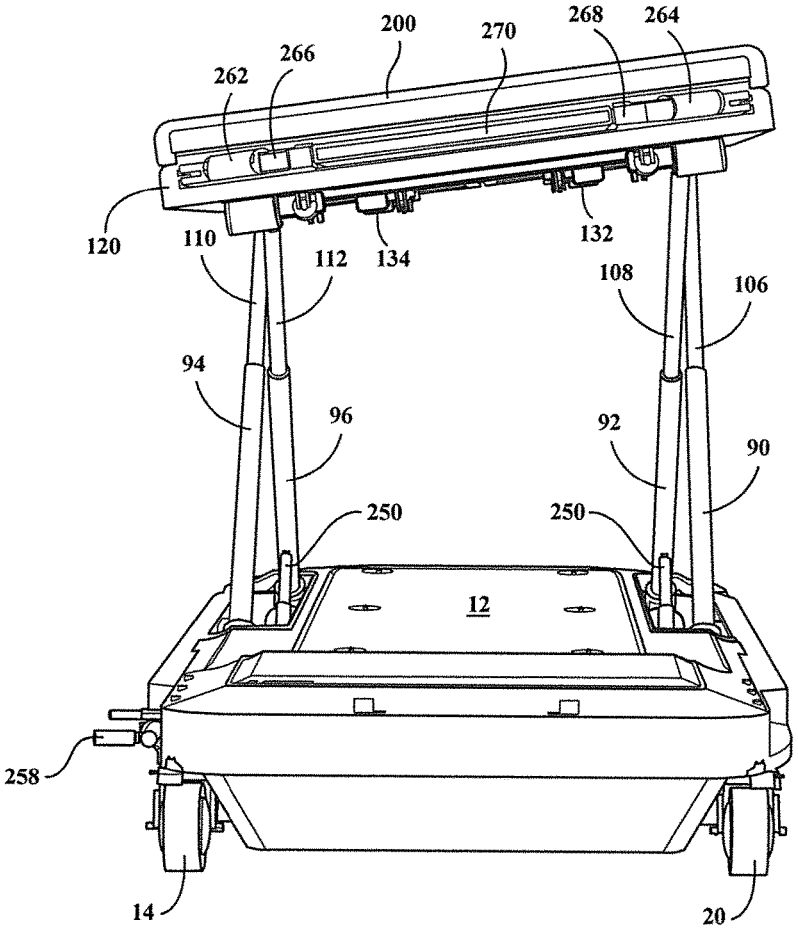
Figure 19:
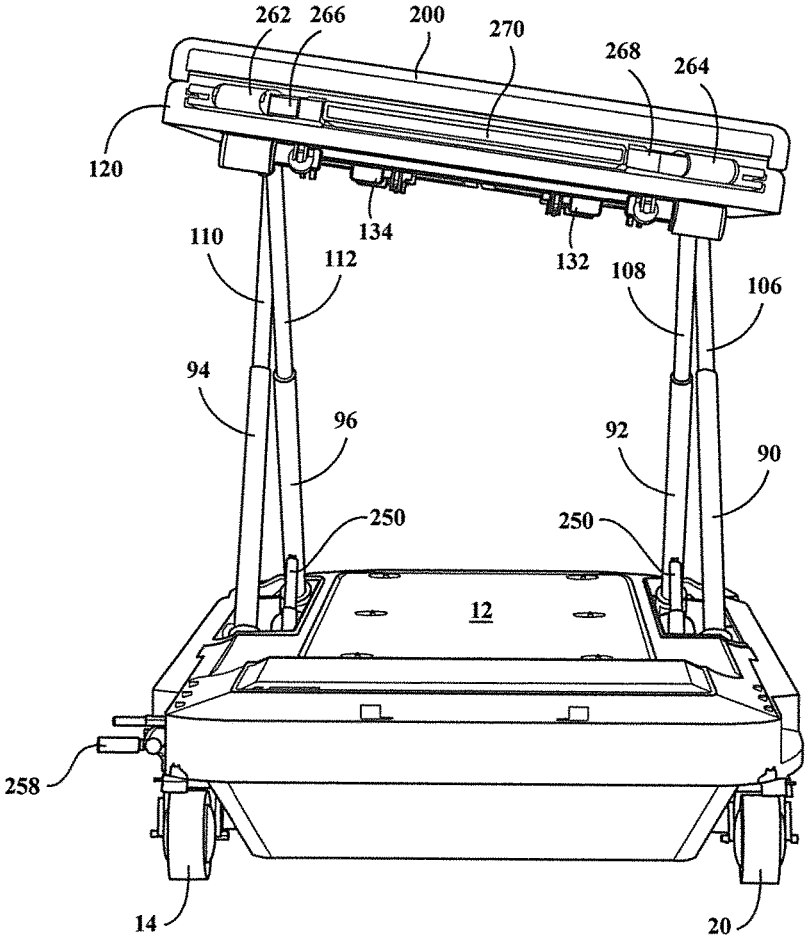

As further previously described, FIGS. 17-19 are end view illustrations of the patient support assembly and depicting reverse (side) tilted positions of the patient support surface which are enabled by selective actuation of the side supporting pairs of cross-extending telescoping subassemblies, these further articulating relative to underside supporting locations of the patient support frame.

FIG. 31 again is a schematic view of a pair of assemblies 10 and 10' arranged in a side-by-side and docked configuration, enabled by the docking component 76 associated with a side location of a first selected assembly and which is upwardly rotated to an engaged position with an opposing side of the second assembly (e.g. such as again gripping an inside of the side extending frame of the second assembly 10'). A cable 280 is shown which extends between connection locations 44 and 44' associated with the patient assemblies 10 and 10', and which provides an optional attachment for cooperatively slaving the motion of the patient support surfaces in order to effect patient transfer.

Figure 32:
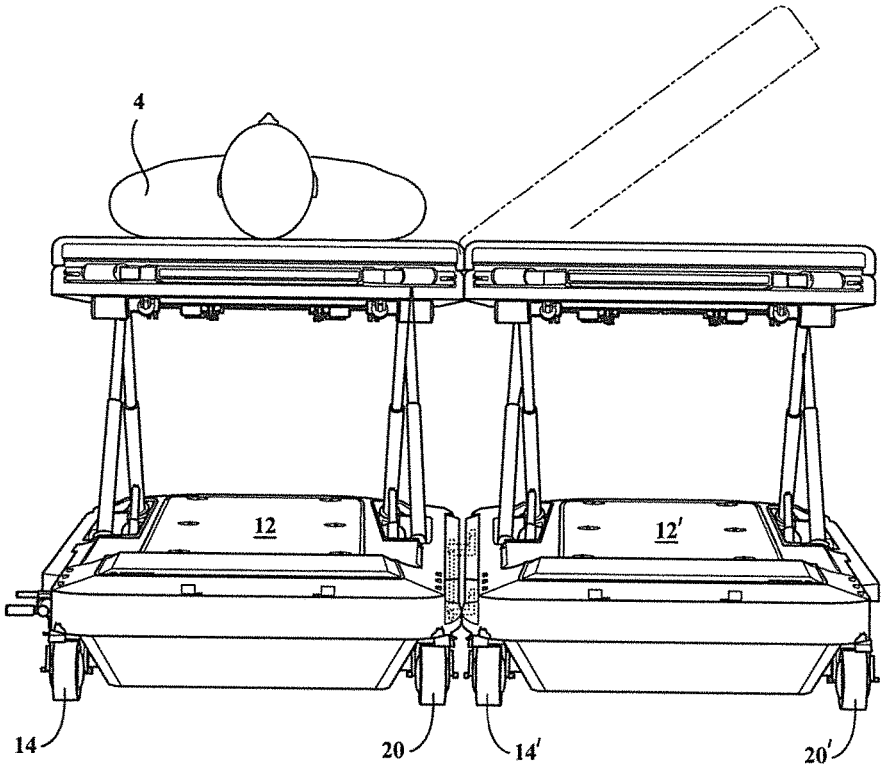
FIGS. 32-34 depict, from an end view, a succession of patient transfer configurations between a pair of docked assemblies, such including the ability to pivot the first and second patient support surfaces about linear horizontal axis', either respective of one another to facilitate turning of the patient during transfer or in unison to effect sliding transfer between the support assemblies.
Figure 33:
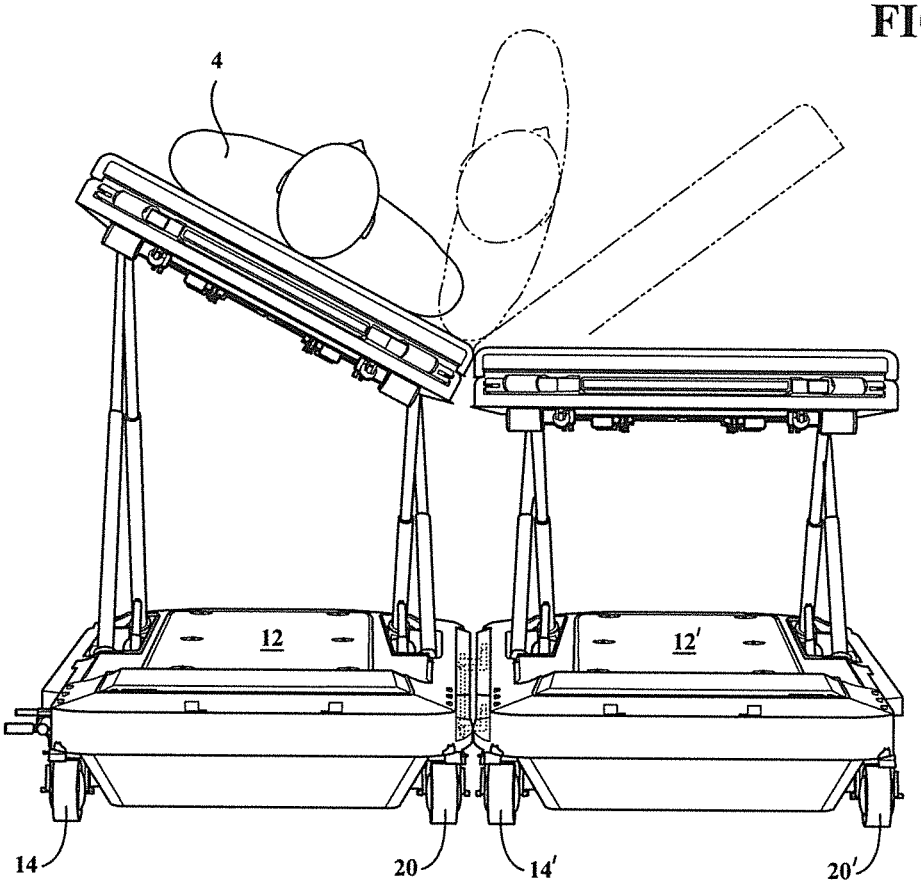
Figure 34:
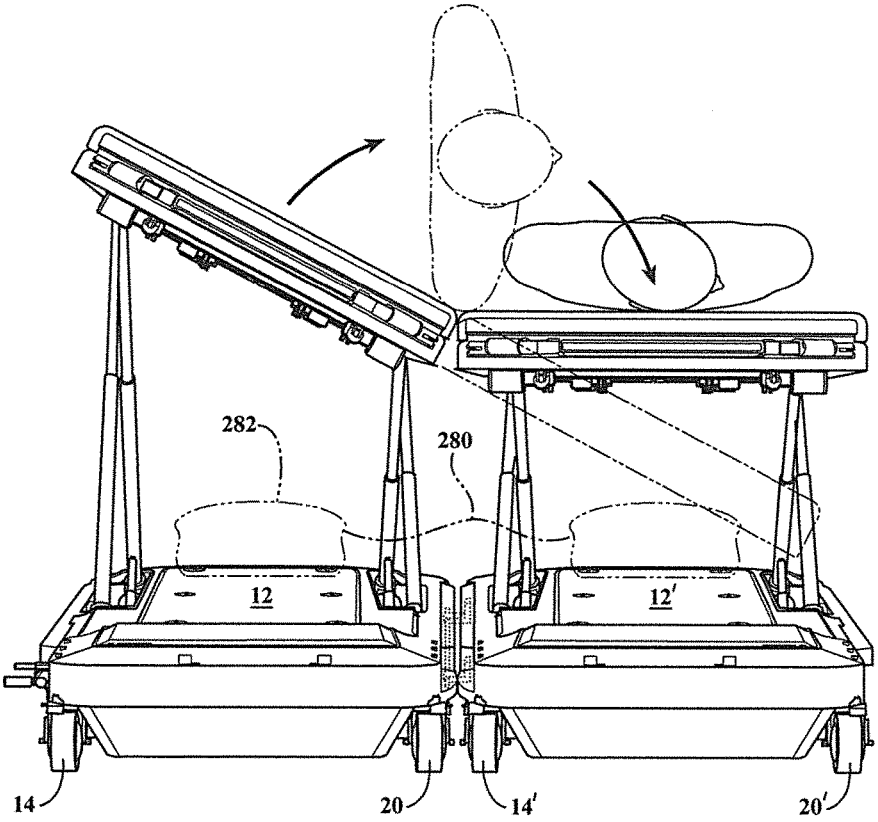

FIGS. 32-34 depict, from an end view, a succession of patient transfer configurations between a pair of docked assemblies, such including the ability to pivot the first and second patient support surfaces about linear horizontal axes, either respective one another to facilitate turning of the patient during transfer or in unison to effect sliding transfer between the support assemblies. Patient transfer can also include such techniques as turning the patient 4 in the manner depicted. Referring again to FIG. 34, the secondary patient support surface can be slaved to the pivoting of the main support surface (again such as through the use of the slaving cable 280 which can connect to input locations of the assemblies via a flip up door 282 or the like), this in order to slide the patient from the first support surface to the second such surface.

Figure 35A:
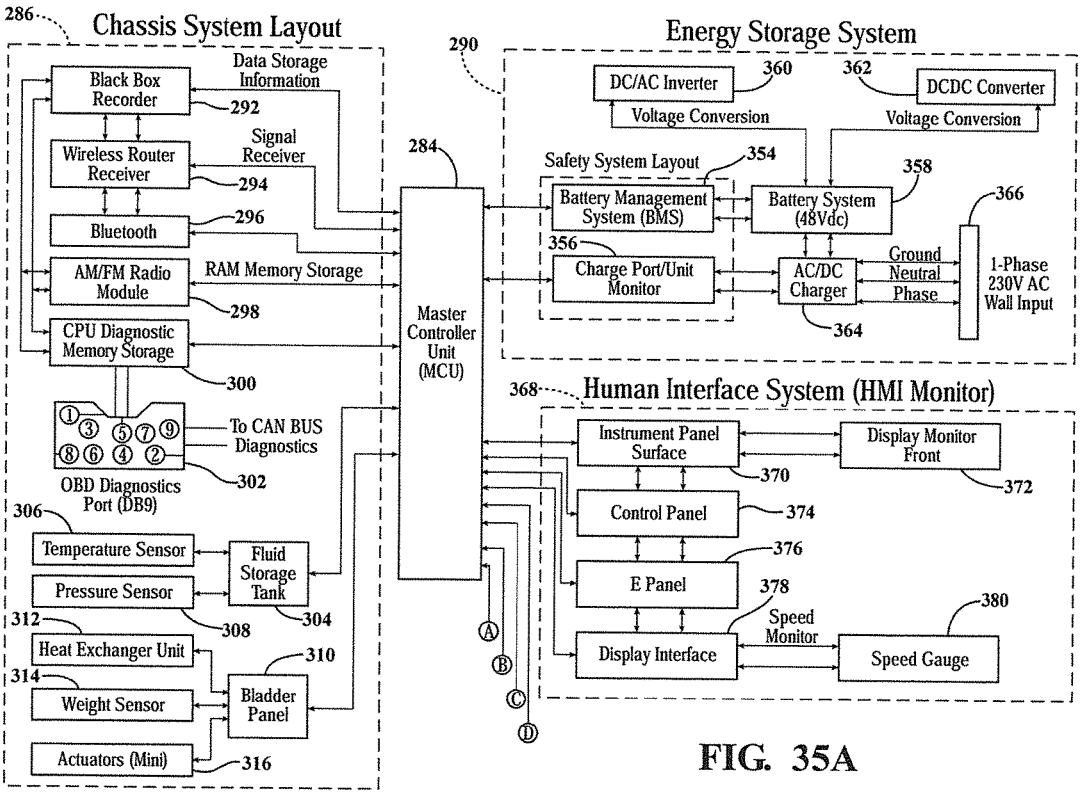
FIGS. 35A and 35B collectively represent a top level control schematic describing the functionality of the present assembly.
Figure 35B:
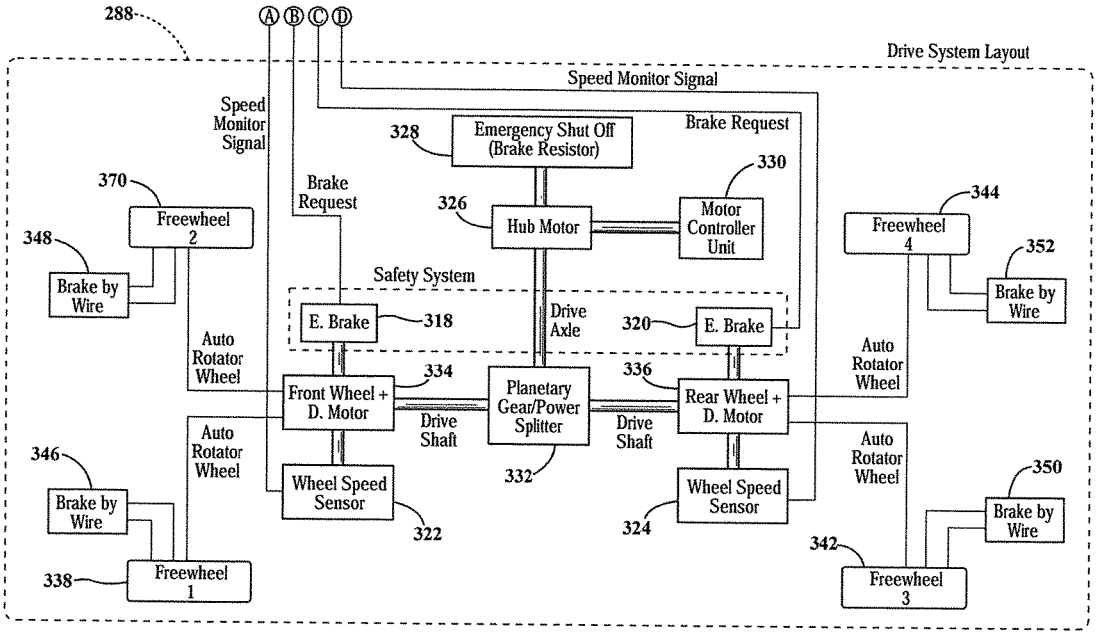

FIGS. 35A and 35B collectively represent a top level control schematic describing the functionality of the present assembly according to one non-limiting variant and which designates, at 284, a suitable processor designated as a master controller unit (MCU) which controls all input and output functions associated with the operation of the various componentry associated with the present system. The MCU 284 interfaces with three main sub-systems, which are segregated into each of a chassis system layout 286, a drive system layout 288 and an energy storage system 290.

Addressing first the chassis system layout 286 in FIG. 35A (such as is associated with various componentry in use with the patient support subassembly), data storage information is collected via a black box recorder 292 which interfaces with the MCU 284. The recorder 292 interfaces in two way communicating fashion with a wireless router receiver 294, which in turn communicates with a Bluetooth® enabled component 296, each of these likewise communicating with the MCU 284.

An AM/FM Radio module 298 is depicted (this providing RAM memory storage in communication with the MCU 284), as is a CPU Diagnostic Memory/Storage component 300 which is in two way communication with the aforementioned black box recorder 292. An OBD Diagnostics port 302 is in further two way communication with the CPU unit 300 and in turn outputs to each of a CAN BUS or other suitable Diagnostics component.

A fluid storage tank 304 (see also fluid tank 42 in FIG. 26) is in two way communication with the MCU 284 and in turn interfaces with a temperatures sensor 306 and pressure sensor 308. A bladder panel 310 is in like two way communication with the MCU 284 and in turn interfaces with each of a heat exchange unit 312, weight sensor 314 and actuators (mini) 316.

Proceeding to a further explanation of the drive system layout 288 as shown in FIG. 35B (see also various descriptions of power drive module 46 in FIGS. 24-27), direct outputs from the MCU 284 are provided to each of the E. Brakes 318 and 320 (termed brake request outputs), as well as to wheel speed sensors 322 and 324 (via speed monitoring signals). A hub motor 326 is provided in communication with each of an emergency shutoff (brake resistor) 328 and a motor controller unit 330. The hub motor 326 engages, via a planetary gear/power splitter 332, with each of front wheel drive motor 334 and rear wheel drive motor 336 via laterally extending drive shafts, these in turn communicating in two way fashion with the afore mentioned wheel speed sensors 322 and 324 in direct communication with the MCU 284.

The front 334 and rear 336 wheel and drive motors each interface with a pair of assembly supporting free wheels (auto rotator wheels) and which are shown by free wheels 338 and 340 associated with front drive wheel 334 and additional free wheels 342 and 344 associated with rear wheel drive motor 336. Braking structure can be incorporated into each of the free wheels and is depicted further by brake by wire components 346, 348, 350 and 352 integrated in two way communicating fashion with each of the wheels 338, 340, 342 and 344, respectively.

Energy storage system 290 set forth in FIG. 35A (such as controlling the portable power supply associated with the multi-functional patient transport assembly) integrates a safety system layout having a battery management system (BMS) 354 and a charge port/unit monitor 356, each of these being in direct two way communication with the MCU 284. A battery system 358 (such as rated at 48V DC) is in communication with the BMS 354 and in turn provides suitable voltage conversion to each of DC/AC inverter 360 and DC/DC converter 362. An AC/DC charger component 364 is likewise in two way communication with the charge port/unit monitor 356 and in turn is established in communication (ground, neutral and phase) with a 1-Phase 230V AC wall input 366.

A fourth and separate human interface system again shown in FIG. 35A (HMI monitor) 368 is provided and includes an instrument panel surface 370 in communication with the MCU 284, and in turn communicating in two way fashion with a front display monitor 372 (see also at 270 and which can provide numerous and varied output functionality not limited to the drive assist mode of FIG. 21). Additional outputs from the MCU 284 extend directly to each of a control panel 374 (such as which can be provided by a portable electronic tablet such as an IPad®), an E panel display 376 and a display interface 378, the latter including two way speed monitor communication with a speed gauge 380.

An associated method is also disclosed for transferring a patient between first and second patient transport assemblies and includes the steps of maneuvering a first self-powered and roller supported patient support assembly into a side-by-side arrangement with a second similarly configured assembly, docking the first and second assemblies together, orienting a first movable patient support surface associated with the first assembly relative to a second patient support surface of the second assembly, and moving a patient supported upon the first support surface to the second support surface. Additional method steps also include rotating a pair of angled docking claws secured at spaced locations along a shaft associated with a side extending location of the first assembly to engage opposing locations of the second patient transport assembly.

Other steps include further orienting the first and second patient support surfaces by pivoting each of the surfaces into any of a common plane or inter-angular relationship. Additional steps include utilizing a blanket extending underneath the patient for effectuating any of pulling/sliding or turning/rotating motion as shown during moving to said second assembly.

Having described our invention, other and additional preferred embodiments will become apparent to those skilled in the art to which it pertains, and without deviating from the scope of the appended claims. This can include reconfiguring the pairs of telescoping supports from that shown and in order to establish any type of sliding or other articulating motion relative to each of the lower base and upper patient underside/frame support locations, this in order to raise, lower, tilt or otherwise reconfigure the patient support surface.

It is also envisioned that the electric actuators and associated cylinders for inter-articulating the patient support sections can be either reconfigured, substituted by other structure or removed from certain variants of the assembly. Additional variants can also contemplate the base being redesigned or simplified to include only passive roller support (without the powered drive module) and further in which much of the on-board controls and power supplies are removed and congregated to a remote attachable module.

We claim:

1. A patient support, transport and diagnostic assembly, comprising: a base having a three dimensional body with an upper surface, a plurality of rollers adapted to support said base upon a floor location; said base including a pair of rails extending along parallel longitudinal axes and in a plane parallel to the upper surface of the base, said rails supporting a propulsion unit for enabling traversal of said base and rollers upon a surface; said propulsion unit including a top turntable plate displaceable along said rails, an outer plate rotatably secured to said turntable plate, a drive housing suspended from said outer plate and including a pair of end supported drive wheels for rotating said drive housing and drive wheels relative to said top turntable plate in addition to said propulsion unit driving said base from any linear adjustable position along said rails; a plurality of powered and processor supported components incorporated into said base and including each of an electronic control unit, a central processing unit, and a battery system; first and second pairs of extensible supports extending from said base, in engagement with locations of a patient support for supporting and vertically adjusting said frame between an uppermost displaced height and a lowermost height in which an underside of said frame is in contact with said upper surface of said base; said pairs of extensible supports being manipulated in varying combinations for additionally providing tilting to said patient support frame; a plurality of patient support cushion sections collectively arranged upon an upper support surface of said patient support frame, each further including a mounting plate supporting a plurality of individually mounted and vertically displaceable sensors, a cushion member through which are formed a plurality of apertures securing over said mounting plate; so that endmost portions of said sensors align with and project through said apertures; and said sensors being in independent communication with said central processing unit for monitoring of patient vitals, said processing unit providing output signals to said sensors for adjusting a bias exerted by each sensor to a patient supported upon said cushion sections for providing varied therapeutic features for reducing muscle atrophy and bed sores while increasing blood circulation.

2. The assembly as described in claim 1, said patient support frame further comprising a plurality of inter-articulating sections.

3. The assembly as described in claim 2, further comprising a plurality of actuator driven cylinders extending between pivotal locations associated with each of said inter-articulating sections.

4. The assembly as described in claim 1, further comprising a plurality of side and end rails retractably mounted to said patient support frame and which are outwardly extensible, following which outer hinged portions of each of said rails are upwardly rotatable and locked.

5. The assembly as described in claim 1, further comprising a pair of supporting rails associated with said patient support frame, each of said supporting rails exhibiting a laterally extending lip for providing sliding support of seating interior facing recess profiles associated with parallel and end extending pedestal locations associated with said mounting plate.

6. The assembly as described in claim 1, further comprising an operator tilt-screen located at an end of said patient support frame and cooperating with a pair of hand grip throttles for permitting operator driving and steering of said assembly.

7. The assembly as described in claim 1, further comprising a fluid pressurized tank for actuating said extensible supports.

8. The assembly as described in claim 7, said extensible supports further comprising telescoping members including outer tubes pivotally secured to locations upon said base, inner tubes seating in extensible/retractable fashion within said outer tubes and in turn being connected in articulating permitting fashion to the patient support frame.

9. The assembly as described in claim 1, further comprising a docking member associated with a selected extending side of said base and, upon positioning said assembly alongside and in edge proximate fashion with a second patient support and transport assembly, said docking member connecting said assemblies together.

10. The assembly as described in claim 9, said docking member further comprising:

an electric motor secured by an associated bracket to said base;

a chain drive extending from a take-off shaft of said motor and engaging a gear mounted to a linear extending and rotatably supported shaft;

a pair of angled docking claws secured at spaced locations along said shaft and upwardly rotatable so that the outer angled portions thereof engage inner facing locations of an opposing second base associated with the second patient support and transport assembly.

11. The assembly as described in claim 1, further comprising a plurality of covering sections interposed between undersides of said mounting plates and underside support locations of said inter-articulating frame sections.

12. The assembly as described in claim 1, further comprising a plurality of side and end rails retractably mounted to said patient support frame and which are outwardly extensible, following which outer hinged portions of each of said rails are upwardly rotatable and locked.

13. The assembly as described in claim 1, said powered and processor supported components further comprising an auxiliary unit incorporating wireless communication capability with a remote network.

14. The assembly as described in claim 6, an end most portion of said upper surface of said base further comprising a pedestal support location positioned underneath said operator tilt-screen and said pair of hand grip throttles for supporting the operator standing on said pedestal support location.

* * * * *